US010323533B2

(12) United States Patent
Hitchman et al.

(10) Patent No.: US 10,323,533 B2
(45) Date of Patent: Jun. 18, 2019

(54) TURBINE COMPONENT THERMAL BARRIER COATING WITH DEPTH-VARYING MATERIAL PROPERTIES

(71) Applicant: Siemens Aktiengesellschaft, München (DE)

(72) Inventors: Neil Hitchman, Charlotte, NC (US); Ramesh Subramanian, Oviedo, FL (US); Cora Schillig, Charlotte, NC (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 274 days.

(21) Appl. No.: 15/121,196

(22) PCT Filed: Feb. 18, 2015

(86) PCT No.: PCT/US2015/016324

§ 371 (c)(1),
(2) Date: Aug. 24, 2016

(87) PCT Pub. No.: WO2015/130527

PCT Pub. Date: Sep. 3, 2015

(65) Prior Publication Data

US 2016/0369636 A1 Dec. 22, 2016

Related U.S. Application Data

(63) Continuation of application No. 14/188,958, filed on Feb. 25, 2014, now Pat. No. 9,151,175, and a (Continued)

(51) Int. Cl.
*F01D 5/28* (2006.01)
*F01D 5/18* (2006.01)

(Continued)

(52) U.S. Cl.
CPC ..... *F01D 11/122* (2013.01); *C23C 4/04* (2013.01); *C23C 4/12* (2013.01); *F01D 5/18* (2013.01);

(Continued)

(58) Field of Classification Search
CPC . F01D 5/18; F01D 5/187; F01D 5/288; F01D 9/02; F01D 9/041; F01D 11/08;

(Continued)

(56) References Cited

U.S. PATENT DOCUMENTS 1,061,206 A 5/1913 Tesla
3,867,061 A 2/1975 Moskowitz (Continued)

FOREIGN PATENT DOCUMENTS

DE 2612210 9/1977
DE 4238369 5/1994

(Continued)

OTHER PUBLICATIONS

PCT International Search Report and Written Opinion dated Oct. 20, 2015 corresponding to PCT Application PCT/US2015/016324 filed Feb. 18, 2015. (12 pages).

*Primary Examiner* — Igor Kershteyn

(57) ABSTRACT

A thermal barrier coating (TBC) with depth-varying material properties is formed on a turbine component. Exemplary depth-varying material properties include physical ductility, strength and thermal resistivity that vary from the TBC layer inner to outer surface. Exemplary ways to modify physical properties include application of plural separate overlying layers of different material composition or by varying the applied material composition during the application of the TBC layer. Various embodiment described herein also apply a calcium-magnesium-aluminum-silicon (CMAS)-retardant material over the TBC layer to retard reaction with or adhesion of CMAS containing combustion particulates to the TBC layer. In other embodiments the CMAS retardant material is also applied within engineered groove features (EGFs) that are formed in the TBC surface.

15 Claims, 19 Drawing Sheets

Related U.S. Application Data continuation of application No. 14/188,941, filed on Feb. 25, 2014, now Pat. No. 8,939,706.

(51) Int. Cl.

| | |
|---|---|
| ***F01D 9/04*** | (2006.01) |
| ***F01D 11/12*** | (2006.01) |
| ***F01D 25/12*** | (2006.01) |
| ***F01D 11/08*** | (2006.01) |
| ***C23C 4/04*** | (2006.01) |
| ***C23C 4/12*** | (2016.01) |
| ***F01D 9/02*** | (2006.01) |

(52) U.S. Cl.

CPC ..... *F01D 5/187* (2013.01); *F01D 5/288* (2013.01); *F01D 9/02* (2013.01); *F01D 9/041* (2013.01); *F01D 11/08* (2013.01); *F01D 25/12* (2013.01); *F05D 2220/31* (2013.01); *F05D 2220/32* (2013.01); *F05D 2230/311* (2013.01); *F05D 2230/312* (2013.01); *F05D 2230/90* (2013.01); *F05D 2240/11* (2013.01); *F05D 2250/00* (2013.01); *F05D 2250/141* (2013.01); *F05D 2250/18* (2013.01); *F05D 2250/181* (2013.01); *F05D 2250/182* (2013.01); *F05D 2250/185* (2013.01); *F05D 2250/23* (2013.01); *F05D 2250/28* (2013.01); *F05D 2250/294* (2013.01); *F05D 2260/202* (2013.01); *F05D 2260/231* (2013.01); *F05D 2260/941* (2013.01); *F05D 2300/10* (2013.01); *F05D 2300/21* (2013.01); *F05D 2300/5023* (2013.01); *F05D 2300/516* (2013.01); *F05D 2300/611* (2013.01)

(58) Field of Classification Search

CPC ..... F01D 11/122; F01D 25/12; C23C 4/04; C23C 4/12; F05D 2220/31; F05D 2220/32; F05D 2230/311; F05D 2230/312; F05D 2230/90; F05D 2240/11; F05D 2250/00; F05D 2250/141; F05D 2250/185; F05D 2250/23; F05D 2250/181; F05D 2250/294; F05D 2250/28; F05D 2250/18; F05D 2250/182; F05D 2260/941; F05D 2260/231; F05D 2260/202; F05D 2300/516; F05D 2300/10; F05D 2300/21; F05D 2300/5023; F05D 2300/611

See application file for complete search history.

(56) References Cited

U.S. PATENT DOCUMENTS

| | | | |
|---|---|---|---|
| 3,970,319 | A | 7/1976 | Carroll et al. |
| 4,028,523 | A | 6/1977 | Anderl et al. |
| 4,152,223 | A | 5/1979 | Wallace et al. |
| 4,289,447 | A | 9/1981 | Sterman et al. |
| 4,303,693 | A | 12/1981 | Driver |
| 4,321,310 | A | 3/1982 | Ulion et al. |
| 4,335,190 | A | 6/1982 | Bill et al. |
| 4,405,284 | A | 9/1983 | Albrecht et al. |
| 4,414,249 | A | 11/1983 | Ulion et al. |
| 4,466,772 | A | 8/1984 | Okapuu et al. |
| 4,514,469 | A | 4/1985 | Loersch et al. |
| 4,714,406 | A | 12/1987 | Hough |
| 4,764,089 | A | 8/1988 | Strangman |
| 4,810,334 | A | 3/1989 | Honey et al. |
| 4,885,213 | A | 12/1989 | Miyamoto et al. |
| 5,057,379 | A | 10/1991 | Fayeulle et al. |
| 5,064,727 | A | 11/1991 | Naik et al. |
| 5,080,934 | A | 1/1992 | Naik et al. |
| 5,124,006 | A | 6/1992 | Fayeulle et al. |
| 5,167,721 | A | 12/1992 | McComas et al. |
| 5,236,745 | A | 8/1993 | Gupta et al. |
| 5,352,540 | A | 10/1994 | Schienle et al. |
| 5,403,669 | A | 4/1995 | Gupta et al. |
| 5,435,889 | A | 7/1995 | Dietrich |
| 5,514,445 | A | 5/1996 | Delage et al. |
| 5,534,308 | A | 7/1996 | Bamberg et al. |
| 5,579,534 | A | 11/1996 | Itoh et al. |
| 5,645,893 | A | 7/1997 | Rickerby et al. |
| 5,681,616 | A | 10/1997 | Gupta et al. |
| 5,716,720 | A | 2/1998 | Murphy |
| 5,721,057 | A | 2/1998 | Bamberg et al. |
| 5,723,078 | A | 3/1998 | Nagaraj et al. |
| 5,817,371 | A | 10/1998 | Gupta et al. |
| 5,817,372 | A | 10/1998 | Zheng |
| 5,866,271 | A | 2/1999 | Stueber et al. |
| 5,894,053 | A | 4/1999 | Fried |
| 5,900,283 | A | 5/1999 | Vakil et al. |
| 5,951,892 | A | 9/1999 | Wolfla et al. |
| 5,952,110 | A | 9/1999 | Schell et al. |
| 6,074,706 | A | 6/2000 | Beverley et al. |
| 6,096,381 | A | 8/2000 | Zheng |
| 6,102,656 | A | 8/2000 | Nissley et al. |
| 6,106,959 | A | 8/2000 | Vance et al. |
| 6,136,453 | A | 10/2000 | Ritter et al. |
| 6,155,778 | A | 12/2000 | Lee et al. |
| 6,159,553 | A | 12/2000 | Li et al. |
| 6,165,628 | A | 12/2000 | Borom et al. |
| 6,171,351 | B1 | 1/2001 | Schroder et al. |
| 6,203,021 | B1 | 3/2001 | Wolfla et al. |
| 6,224,963 | B1 | 5/2001 | Strangman |
| 6,231,998 | B1 | 5/2001 | Bowker et al. |
| 6,235,370 | B1 | 5/2001 | Merrill et al. |
| 6,242,050 | B1 | 6/2001 | Ritter et al. |
| 6,251,526 | B1 | 6/2001 | Staub |
| 6,264,766 | B1 | 7/2001 | Ritter et al. |
| 6,274,201 | B1 | 8/2001 | Borom et al. |
| 6,316,078 | B1 | 11/2001 | Smialek |
| 6,361,878 | B2 | 3/2002 | Ritter et al. |
| 6,368,727 | B1 | 4/2002 | Ritter et al. |
| 6,387,527 | B1 | 5/2002 | Hasz et al. |
| 6,440,575 | B1 | 8/2002 | Heimberg et al. |
| 6,444,331 | B2 | 9/2002 | Ritter et al. |
| 6,457,939 | B2 | 10/2002 | Ghasripoor et al. |
| 6,471,881 | B1 | 10/2002 | Chai et al. |
| 6,482,469 | B1 | 11/2002 | Spitsberg et al. |
| 6,485,845 | B1 | 11/2002 | Wustman et al. |
| 6,503,574 | B1 | 1/2003 | Skelly et al. |
| 6,527,509 | B2 | 3/2003 | Kurokawa et al. |
| 6,541,075 | B2 | 4/2003 | Hasz et al. |
| 6,582,189 | B2 | 6/2003 | Irie et al. |
| 6,607,789 | B1 | 8/2003 | Rigney et al. |
| 6,637,643 | B2 | 10/2003 | Hasz et al. |
| 6,641,907 | B1 | 11/2003 | Merrill et al. |
| 6,652,227 | B2 | 11/2003 | Fried |
| 6,716,539 | B2 | 4/2004 | Subramanian |
| 6,720,087 | B2 | 4/2004 | Fried et al. |
| 6,764,771 | B1 | 7/2004 | Heimberg et al. |
| 6,812,471 | B2 | 11/2004 | Popiolkowski et al. |
| 6,821,578 | B2 | 11/2004 | Beele |
| 6,830,428 | B2 | 12/2004 | Le Biez et al. |
| 6,846,574 | B2 | 1/2005 | Subramanian |
| 6,887,528 | B2 | 5/2005 | Lau et al. |
| 6,887,595 | B1 | 5/2005 | Darolia et al. |
| 6,905,305 | B2 | 6/2005 | James |
| 7,029,232 | B2 | 4/2006 | Tuffs et al. |
| 7,029,721 | B2 | 4/2006 | Hasz et al. |
| 7,150,921 | B2 | 12/2006 | Nelson et al. |
| 7,172,820 | B2 | 2/2007 | Darolia et al. |
| 7,182,580 | B2 | 2/2007 | Bostanjoglo et al. |
| 7,182,581 | B2 | 2/2007 | Bostanjoglo et al. |
| 7,210,905 | B2 | 5/2007 | Lapworth |
| 7,220,458 | B2 | 5/2007 | Hollis et al. |
| 7,250,222 | B2 | 7/2007 | Halberstadt et al. |
| 7,338,250 | B2 | 3/2008 | Martindale et al. |
| 7,338,719 | B2 | 3/2008 | Quadakkers et al. |
| 7,378,132 | B2 | 5/2008 | Renteria et al. |
| 7,416,788 | B2 | 8/2008 | Floyd et al. |
| 7,462,378 | B2 | 12/2008 | Nowak et al. |

(56) References Cited

U.S. PATENT DOCUMENTS

| | | | |
|---|---|---|---|
| 7,479,328 | B2 | 1/2009 | Roth-Fagaraseanu et al. |
| 7,507,484 | B2 | 3/2009 | Kulkarni et al. |
| 7,509,735 | B2 | 3/2009 | Philip et al. |
| 7,510,743 | B2 | 3/2009 | Subramanian |
| 7,600,968 | B2 | 10/2009 | Nelson et al. |
| 7,614,847 | B2 | 11/2009 | Nelson et al. |
| 7,686,570 | B2 | 3/2010 | Allen |
| 7,723,249 | B2 | 5/2010 | Doesburg et al. |
| 7,736,704 | B2 | 6/2010 | Chandra et al. |
| 7,819,625 | B2 | 10/2010 | Merrill et al. |
| 7,871,244 | B2 | 1/2011 | Marini et al. |
| 7,935,413 | B2 | 5/2011 | Stamm |
| 7,955,708 | B2 | 6/2011 | Doesburg et al. |
| 7,968,144 | B2 | 6/2011 | James et al. |
| 8,007,246 | B2 | 8/2011 | Rowe et al. |
| 8,021,742 | B2 | 9/2011 | Anoshkina et al. |
| 8,061,978 | B2 | 11/2011 | Tholen et al. |
| 8,079,806 | B2 | 12/2011 | Tholen et al. |
| 8,100,629 | B2 | 1/2012 | Lebret |
| 8,123,466 | B2 | 2/2012 | Pietraszkiewicz et al. |
| 8,124,252 | B2 | 2/2012 | Cybulsky et al. |
| 8,137,820 | B2 | 3/2012 | Fairbourn |
| 8,177,494 | B2 | 5/2012 | Ward et al. |
| 8,209,831 | B2 | 7/2012 | Boehm et al. |
| 8,303,247 | B2 | 11/2012 | Schlichting et al. |
| 8,376,697 | B2 | 2/2013 | Wiebe et al. |
| 8,388,309 | B2 | 3/2013 | Marra et al. |
| 8,453,327 | B2 | 6/2013 | Allen |
| 8,506,243 | B2 | 8/2013 | Strock et al. |
| 8,511,993 | B2 | 8/2013 | Kemppainen et al. |
| 8,535,783 | B2 | 9/2013 | Lutjen et al. |
| 8,586,172 | B2 | 11/2013 | Rosenzweig et al. |
| 8,770,926 | B2 | 7/2014 | Guo et al. |
| 2001/0037823 | A1 | 11/2001 | Middelman et al. |
| 2003/0039764 | A1 | 2/2003 | Burns et al. |
| 2003/0054108 | A1 | 3/2003 | Beele |
| 2003/0101587 | A1 | 6/2003 | Rigney et al. |
| 2003/0175116 | A1 | 9/2003 | Le Biez et al. |
| 2004/0256504 | A1 | 12/2004 | Segrest et al. |
| 2004/0265120 | A1 | 12/2004 | Tuffs et al. |
| 2005/0003172 | A1 | 1/2005 | Wheeler et al. |
| 2005/0036892 | A1 | 2/2005 | Bajan |
| 2005/0164027 | A1 | 7/2005 | Lau et al. |
| 2005/0178126 | A1 | 8/2005 | Young et al. |
| 2005/0228098 | A1 | 10/2005 | Skoog et al. |
| 2005/0249602 | A1 | 11/2005 | Freling et al. |
| 2005/0260434 | A1 | 11/2005 | Nelson et al. |
| 2005/0266163 | A1 | 12/2005 | Wortman et al. |
| 2006/0105182 | A1 | 5/2006 | Brueckner et al. |
| 2006/0110248 | A1 | 5/2006 | Nelson et al. |
| 2007/0110900 | A1 | 5/2007 | Nowak et al. |
| 2007/0160859 | A1 | 7/2007 | Darolia et al. |
| 2007/0178247 | A1 | 8/2007 | Bucci et al. |
| 2008/0044273 | A1 | 2/2008 | Khalid |
| 2008/0057214 | A1 | 3/2008 | Fagoaga Altuna et al. |
| 2008/0145643 | A1 | 6/2008 | Reynolds et al. |
| 2008/0145694 | A1 | 6/2008 | Bucci |
| 2008/0206542 | A1 | 8/2008 | Vance et al. |
| 2008/0260523 | A1 | 10/2008 | Alvanos et al. |
| 2008/0274336 | A1 | 11/2008 | Merrill et al. |
| 2009/0017260 | A1 | 1/2009 | Kulkarni et al. |
| 2009/0162670 | A1 | 6/2009 | Lau et al. |
| 2009/0311416 | A1 | 12/2009 | Nelson et al. |
| 2009/0324401 | A1 | 12/2009 | Calla |
| 2010/0003894 | A1 | 1/2010 | Miller et al. |
| 2010/0104764 | A1 | 4/2010 | Nazmy |
| 2010/0104773 | A1 | 4/2010 | Neal et al. |
| 2010/0136254 | A1 | 6/2010 | Darolia et al. |
| 2011/0003119 | A1 | 1/2011 | Doesburg et al. |
| 2011/0014060 | A1* | 1/2011 | Bolcavage ..... F01D 5/288 416/241 R |
| 2011/0044821 | A1 | 2/2011 | Rowe et al. |
| 2011/0048017 | A1 | 3/2011 | Margolies et al. |
| 2011/0076413 | A1 | 3/2011 | Margolies et al. |
| 2011/0097538 | A1* | 4/2011 | Bolcavage ..... F01D 5/288 428/137 |
| 2011/0116920 | A1 | 5/2011 | Strock et al. |
| 2011/0143163 | A1 | 6/2011 | Halberstadt et al. |
| 2011/0151219 | A1 | 6/2011 | Nagaraj et al. |
| 2011/0182720 | A1 | 7/2011 | Kojima et al. |
| 2012/0063881 | A1 | 3/2012 | Tallman |
| 2012/0107103 | A1 | 5/2012 | Kojima et al. |
| 2012/0272653 | A1 | 11/2012 | Merrill et al. |
| 2012/0275908 | A1 | 11/2012 | Guo et al. |
| 2013/0004305 | A1 | 1/2013 | Giovannetti et al. |
| 2013/0017072 | A1 | 1/2013 | Ali et al. |
| 2013/0034661 | A1 | 2/2013 | Schneiderbanger et al. |
| 2013/0052415 | A1 | 2/2013 | Burns et al. |
| 2013/0122259 | A1 | 5/2013 | Lee |
| 2013/0186304 | A1 | 7/2013 | Pabla et al. |
| 2013/0189441 | A1 | 7/2013 | Pabla et al. |
| 2014/0127005 | A1 | 5/2014 | Schreiber |

FOREIGN PATENT DOCUMENTS

| | | | |
|---|---|---|---|
| DE | 10057187 | | 5/2002 |
| DE | 10117127 | | 10/2002 |
| DE | 10124398 | | 11/2002 |
| DE | 10241741 | | 3/2004 |
| DE | 10357180 | | 6/2005 |
| DE | 10200505873 | | 4/2007 |
| DE | 102009011913 | | 9/2010 |
| DE | 102011004503 | | 8/2012 |
| DE | 102011077620 | | 12/2012 |
| EP | 0816526 | | 1/1998 |
| EP | 1217089 | | 6/2002 |
| EP | 1260608 | | 11/2002 |
| EP | 1304395 | | 4/2003 |
| EP | 0944767 | | 4/2004 |
| EP | 1491657 | | 12/2004 |
| EP | 1491658 | | 12/2004 |
| EP | 1522604 | | 4/2005 |
| EP | 2140973 | | 6/2010 |
| EP | 2202328 | | 6/2010 |
| EP | 2233450 | A1 | 9/2010 |
| EP | 2275645 | A2 | 1/2011 |
| EP | 2395129 | A1 | 12/2011 |
| EP | 2434102 | | 3/2012 |
| EP | 2589872 | | 5/2013 |
| GB | 2222179 | | 2/1990 |
| RU | 2039631 | C1 | 7/1995 |
| WO | 9943861 | | 9/1999 |
| WO | 2005038074 | | 4/2005 |
| WO | 20110085376 | A1 | 7/2011 |
| WO | 2012160586 | | 11/2012 |

* cited by examiner

TURBINE COMPONENT THERMAL BARRIER COATING WITH DEPTH-VARYING MATERIAL PROPERTIES

PRIORITY CLAIM AND CROSS-REFERENCE TO RELATED APPLICATIONS

This application claims priority under the following United States Patent Applications, the entire contents of each of which is incorporated by reference herein:

"TURBINE ABRADABLE LAYER WITH PROGRESSIVE WEAR ZONE HAVING A FRANGIBLE OR PIXELATED NIB SURFACE", filed Feb. 25, 2014, and assigned Ser. No. 14/188,941; and "TURBINE ABRADABLE LAYER WITH PROGRESSIVE WEAR ZONE MULTI LEVEL RIDGE ARRAYS", filed Feb. 25, 2014, and assigned Ser. No. 14/188,958.

A concurrently filed International Patent Application entitled "TURBINE ABRADABLE LAYER WITH AIRFLOW DIRECTING PIXELATED SURFACE FEATURE PATTERNS", PCT/US2015/016271 is identified as a related application and is incorporated by reference herein.

The following United States Patent Applications are identified as related applications for purposes of examining the presently filed application, the entire contents of each of which is incorporated by reference herein:

"TURBINE ABRADABLE LAYER WITH PROGRESSIVE WEAR ZONE TERRACED RIDGES", filed Feb. 25, 2014 and assigned Ser. No. 14/188,992;

"TURBINE ABRADABLE LAYER WITH PROGRESSIVE WEAR ZONE MULTI DEPTH GROOVES", filed Feb. 25, 2014 and assigned Ser. No. 14/188,813;

"TURBINE ABRADABLE LAYER WITH ASYMMETRIC RIDGES OR GROOVES", filed Feb. 25, 2014 and assigned Ser. No. 14/189,035;

"TURBINE ABRADABLE LAYER WITH ZIG-ZAG GROOVE PATTERN", filed Feb. 25, 2014 and assigned Ser. No. 14/189,081; and "TURBINE ABRADABLE LAYER WITH NESTED LOOP GROOVE PATTERN", filed Feb. 25, 2014 and assigned Ser. No. 14/189,011.

TECHNICAL FIELD

The invention relates to combustion or steam turbine engines having thermal barrier coating (TBC) layers on its component surfaces that are exposed to heated working fluids, such as combustion gasses or high pressure steam, including individual sub-components that incorporate such thermal barrier coatings. The invention also relates to methods for reducing crack propagation or spallation damage to such turbine engine component TBC layers that are often caused by engine thermal cycling or foreign object damage (FOD). More particularly various embodiments described herein relate to formation of an overlying thermal barrier coating (TBC) with depth-varying material properties on a turbine component. Exemplary depth-varying material properties include fracture toughness, elastic modulus, porosity and thermal conductivity that vary from the TBC layer inner to outer surface. Exemplary ways to modify physical properties include application of plural separate overlying layers of different material composition or by varying the applied material composition during the thermal spray application of the TBC layer. Various embodiments described herein also apply a calcium-magnesium-aluminum-silicon (CMAS)-retardant material over the TBC layer to retard reaction with or adhesion of CMAS containing combustion particulates to the TBC layer.

BACKGROUND OF THE INVENTION

Known turbine engines, including gas/combustion turbine engines and steam turbine engines, incorporate shaft-mounted turbine blades circumferentially circumscribed by a turbine casing or housing. The remainder of this description focuses on applications within combustion or gas turbine technical application and environment, though exemplary embodiments described herein are applicable to steam turbine engines. In a gas/combustion turbine engine hot combustion gasses flow in a combustion path that initiates within a combustor and are directed through a generally tubular transition into a turbine section. A forward or Row 1 vane directs the combustion gasses past successive alternating rows of turbine blades and vanes. Hot combustion gas striking the turbine blades cause blade rotation, thereby converting thermal energy within the hot gasses to mechanical work, which is available for powering rotating machinery, such as an electrical generator.

Engine internal components within the hot combustion gas path are exposed to combustion temperatures on the order of 900 degrees Celsius (1600 degrees Fahrenheit). The engine internal components within the combustion path, such as for example combustion section transitions, vanes and blades are often constructed of high temperature resistant superalloys. Blades and vanes often include cooling passages terminating in cooling holes on component outer surface, for passage of coolant fluid into the combustion path.

Turbine engine internal components often incorporate a thermal barrier coat or coating (TBC) of metal-ceramic material that is applied directly to the external surface of the component substrate surface or over an intermediate metallic bond coat (BC) that was previously applied to the substrate surface. The TBC provides an insulating layer over the component substrate, which reduces the substrate temperature. Combination of TBC application along with cooling passages in the component further lowers the substrate temperature.

Due to differences in thermal expansion, fracture toughness and elastic modulus—among other things—between typical metal-ceramic TBC materials and typical superalloy materials used to manufacture the aforementioned exemplary turbine components, there is potential risk of cracking the TBC layer as well as TBC/turbine component adhesion loss at the interface of the dissimilar materials. The cracks and/or adhesion loss/delamination negatively impact the TBC layer structural integrity and potentially lead to its spallation, i.e., separation of the insulative material from the turbine component. For example, vertical cracks developing within the TBC layer can propagate to the TBC/substrate interface, and then spread horizontally. Similarly, horizontally oriented cracks can originate within the TBC layer or proximal the TBC/substrate interface. Such cracking loss of TBC structural integrity can lead to further, premature damage to the underlying component substrate. When the TBC layer breaks away from underlying substrate the latter loses its protective thermal layer coating. During continued operation of the turbine engine it is possible over time that the hot combustion gasses will erode or otherwise damage the exposed component substrate surface, potentially reducing engine operation service life. Potential spallation risk increases with successive powering on/off cycles as the engine is brought on line to generate electrical power in response to electric grid increased load demands and idling down as grid load demand decreases. In order to manage the TBC spallation risk and other engine operational maintenance needs, combustion turbine engines are often taken out of service for inspection and maintenance after a defined number of powering on/off thermal cycles.

In addition to thermal or vibration stress crack susceptibility, the TBC layer on engine components is also susceptible to foreign object damage (FOD) as contaminant particles within the hot combustion gasses strike the relatively brittle TBC material. A foreign object impact can crack the TBC surface, ultimately causing spallation loss of surface integrity that is analogous to a road pothole. Once foreign object impact spalls of a portion of the TBC layer, the remaining TBC material is susceptible to structural crack propagation and/or further spatting of the insulative layer. In addition to environmental damage of the TBC layer by foreign objects, contaminants in the combustion gasses, such as calcium, magnesium, aluminum and silicon (often referred to as "CMAS") can adhere to or react with the TBC layer, increasing the probability of TBC spallation and exposing the underlying bond coat.

Past attempts to enhance TBC layer structural integrity and affixation to underlying turbine component substrates have included development of stronger TBC materials better able to resist thermal cracking or FOD, but with tradeoffs in reduced thermal resistivity or increased material cost. Generally the relatively stronger, less brittle potential materials for TBC application have had lower thermal resistivity. Alternatively, as a compromise separately applied multiple layers of TBC materials having different advantageous properties have been applied to turbine component substrates—for example a more brittle or softer TBC material having better insulative properties that is in turn covered by a stronger, lower insulative value TBC material as a tougher "armor" outer coating better able to resist FOD and/or CMAS contaminant adhesion. In order to improve TBC adhesion to the underlying substrate, intermediate metallic bond coat (BC) layers have been applied directly over the substrate. Structural surface properties and/or profile of the substrate or BC interface to the TBC have also been modified from a flat, bare surface. Some known substrate and/or BC surface modifications (e.g., so-called "rough bond coats" or RBCs) have included roughening the surface by ablation or other blasting, thermal spray deposit or the like. In some instances the BC or substrate surface has been photoresist or laser etched to include surface features on the order of a few microns (μm) height and spacing width across the surface planform. Features have been formed directly on the substrate surface of turbine blade tips to mitigate stress experienced in blade tip coatings. Rough bond coats have been thermally sprayed to leave porous surfaces of a few micron-sized features. TBC layers have been applied by locally varying homogeneity of the applied ceramic-metallic material to create pre-weakened zones for attracting crack propagation in controlled directions. For example a weakened zone has been created in the TBC layer corresponding to a known or likely stress concentration zone, so that any cracks developing therein are propagated in a desired direction to minimize overall structural damage to the TBC layer.

SUMMARY OF THE INVENTION

Various embodiments of turbine component construction and methods for making turbine components that are described herein help preserve turbine component thermal barrier coating (TBC) layer structural integrity during turbine engine operation. In some embodiments engineered surface features (ESFs) formed directly in the component substrate or in intermediate layers applied over the substrate enhance TBC layer adhesion thereto. In some embodiments the ESFs function as walls or barriers that contain or isolate cracks in the TBC layer, inhibiting additional crack propagation within that layer or delamination from adjoining coupled layers.

In some embodiments engineered groove features (EGFs) are formed in the TBC layer through the outer surface thereof, such as by laser or water jet ablation or mechanical cutting into a previously formed TBC layer. The EGFs—functioning as the equivalent of a fire line that prevents a fire from spreading across a void or gap in combustible material—stop further crack propagation in the TBC layer across the groove to other zones in the TBC layer. EGFs in some embodiments are aligned with stress zones that are susceptible to development of cracks during engine operation. In such embodiments, formation of a groove in the stress zone removes material that possibly or likely will form a stress crack during engine operation. In other embodiments EGFs are formed in convenient two dimensional or polygonal planform patterns into the TBC layer. The EGFs localize thermal stress- or foreign object damage (FOD)-induced crack propagation within the TBC that might otherwise allow excessive TBC spallation and subsequent thermal exposure damage to the turbine component's underlying substrate. A given TBC surface area that has developed one or more stress cracks is isolated from non-cracked portions that are outside of the EGFs. Therefore, if the cracked portion isolated by one or more EGFs spalls from the component the remaining TBC surface outside the crack containing grooves will not spall off as a consequence of the contained crack(s).

In some embodiments spallation of cracked TBC material that is constrained within ESFs and/or EGFs leaves a partial underlying TBC layer that is analogous to a road pot hole. The underlying TBC material that forms the floor or base of the "pot hole" provides continuing thermal protection for the turbine engine component's underlying substrate.

In some embodiments a turbine component has a thermally sprayed overlying thermal barrier coating (TBC) with depth-varying material properties. Exemplary depth-varying material properties include elastic modulus, fracture toughness and thermal conductivity that vary from the TBC layer inner to outer surface. Exemplary ways to modify physical properties include application of plural separate overlying layers of different material composition or by varying the applied material composition during the thermal spray application of the TBC layer.

Some embodiments also apply a calcium-magnesium-aluminum-silicon (CMAS)-retardant material over the TBC layer to retard reaction with or adhesion of CMAS containing combustion particulates to the TBC layer. When CMAS-retardant layers are applied over EGFs they inhibit accumulation of foreign material within the grooves and also provide smoother boundary layer surfaces to enhance combustion gas flow aerodynamic efficiency.

More particularly embodiments of the invention described herein feature a combustion turbine component having a heat insulating outer surface for exposure to combustion gas, which includes a metallic substrate having a substrate surface; an anchoring layer built upon the substrate surface; and a thermally sprayed or vapor deposited or solution/suspension plasma sprayed thermal barrier coat (TBC) layer having a TBC total thickness, with a TBC inner surface coupled to the anchoring layer and a TBC outer surface for exposure to combustion gas. The TBC layer material fracture toughness, elastic modulus, porosity and thermal conductivity properties varying from the TBC inner surface to the TBC outer surface. A planform pattern of engineered surface features (ESFs) project from the anchoring layer having projection height between approximately 2-75 percent of the TBC layer total thickness. A planform pattern of engineered groove features (EGFs) is formed into and penetrates the previously applied TBC layer through the TBC outer surface. The respective EGFs have a groove depth.

Other embodiments of the invention described herein feature a method for making a combustion turbine component having a heat insulating outer surface for exposure to combustion gas, by providing a metallic substrate having a substrate surface. An anchoring layer is built upon the substrate surface. A thermally sprayed or vapor deposited or solution/suspension plasma sprayed monolithic layer thermal barrier coat (TBC) having a TBC layer thickness is formed over the anchoring layer. The formed TBC layer has an inner surface coupled to the anchoring layer and a TBC outer surface for exposure to combustion gas. Composition of the TBC layer material is varied progressively as the TBC layer is being continuously applied over the anchoring layer.

Additional embodiments of the invention described herein feature a method for making a combustion turbine component having a heat insulating outer surface for exposure to combustion gas. A metallic substrate having a substrate surface is provided. An anchoring layer is built upon the substrate surface, which includes a planform pattern of engineered surface features (ESFs) projecting from the anchoring layer. A thermally sprayed or vapor deposited or solution/suspension plasma sprayed monolithic layer thermal barrier coat (TBC) is formed over the anchoring layer. The TBC has a TBC layer thickness, an inner surface coupled to the anchoring layer and a TBC outer surface for exposure to combustion gas. Composition of the TBC layer material is varied progressively as the TBC layer is being applied over the anchoring layer. A planform pattern of engineered groove features (EGFs) is formed on and penetrates the previously applied TBC layer through the TBC outer surface. The respective EGFs have a groove depth.

The respective features of the various embodiments described herein invention may be applied jointly or severally in any combination or sub-combination.

BRIEF DESCRIPTION OF THE DRAWINGS

The embodiments shown and described herein can be understood by considering the following detailed description in conjunction with the accompanying drawings, in which.

Figure 1:
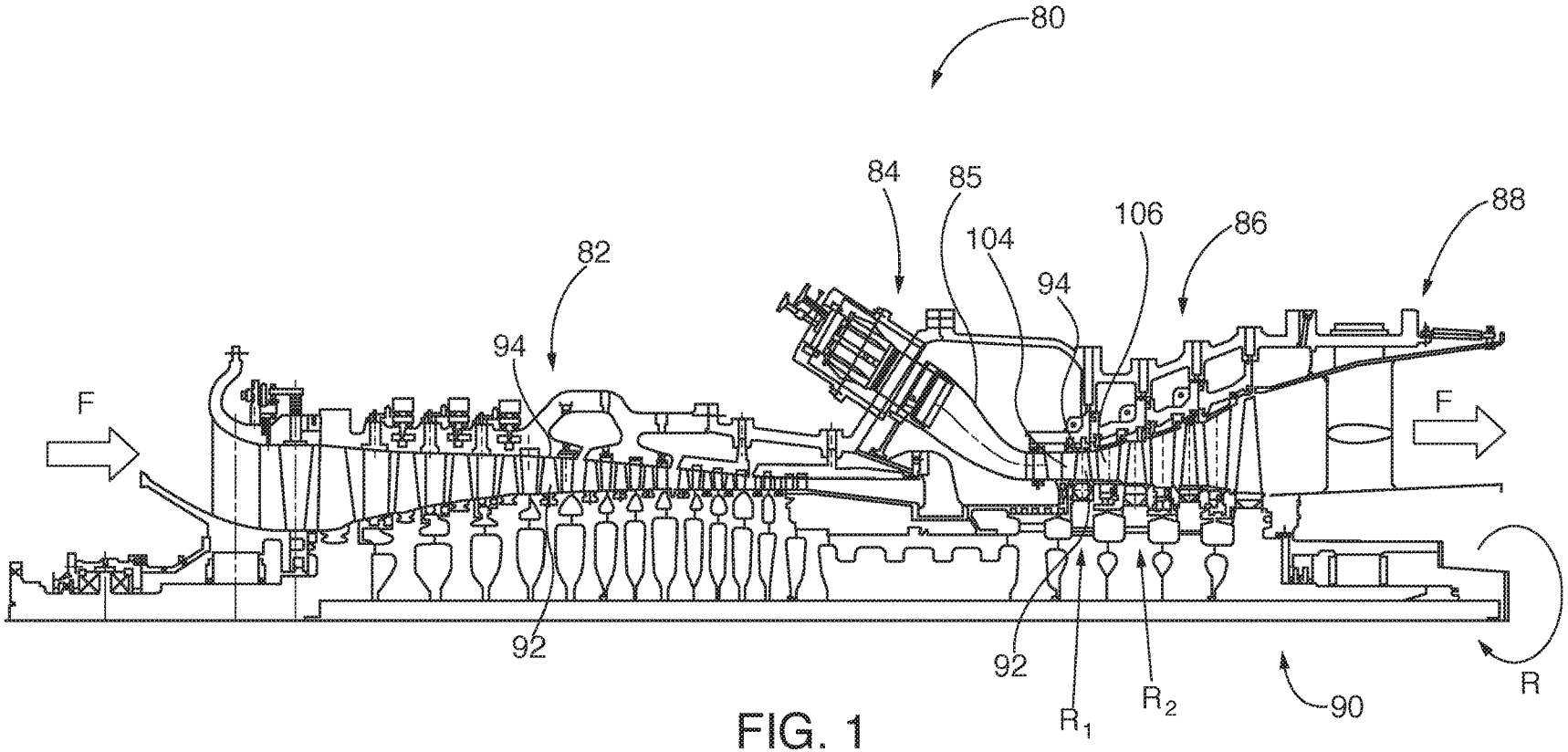
FIG. 1 is a partial axial cross sectional view of a gas or combustion turbine engine incorporating one more exemplary thermal barrier coating embodiments of the invention.

To facilitate understanding, identical reference numerals have been used, where possible, to designate identical elements that are common to the figures. The figures are not drawn to scale. The following common designators for dimensions, cross sections, fluid flow, axial or radial orientation and turbine blade rotation have been utilized throughout the various invention embodiments described herein:

C—C cross section;
$D_G$ groove depth;
F flow direction through turbine engine;
G turbine blade tip to abradable surface gap;
H height of a surface feature;
$H_R$ ridge height;
L length of a surface feature;
R turbine blade rotational direction;
$R_1$ Row 1 of the turbine engine turbine section;
$R_2$ Row 2 of the turbine engine turbine section;
$S_R$ ridge centerline spacing;
$S_G$ groove spacing;
T thermal barrier coat (TBC) layer thickness;
W width of a surface feature;
$W_G$ groove width;
$W_R$ abradable ridge width;
$\Delta$ groove skew angle relative to abradable ridge longitudinal/axial axis; and
$\sigma$ stress concentration in a thermal barrier coating (TBC).

DESCRIPTION OF EMBODIMENTS

Exemplary embodiments of the present invention enhance performance of the thermal barrier coatings (TBCs) that are applied to surfaces of turbine engine components, including combustion or gas turbine engines, as well as steam turbine engines. In exemplary embodiments of the invention that are described in greater detail herein, an overlying thermal barrier coating (TBC) with depth-varying material properties is formed as an outer layer on a turbine component. Exemplary depth-varying material properties include physical ductility, strength and thermal resistivity that vary from the TBC layer inner to outer surfaces. Exemplary ways to modify physical properties include application of plural separate overlying layers of different material composition or by varying the applied material composition during the thermal spray application of the TBC layer. Various embodiments described herein also apply a calcium-magnesium-aluminum-silicon (CMAS)-retardant material over the TBC layer to retard reaction with or adhesion of CMAS containing combustion particulates to the TBC layer. The CMAS-retardant layer enhances surface boundary layer aerodynamics by avoiding accumulation of the particulates to the otherwise smooth TBC layer outer surface. When the CMAS-retardant layer is applied over engineered groove features (EGFs) it enhances boundary layer aerodynamics by covering the grooves and also inhibits accumulation of debris within the grooves.

Figure 2:
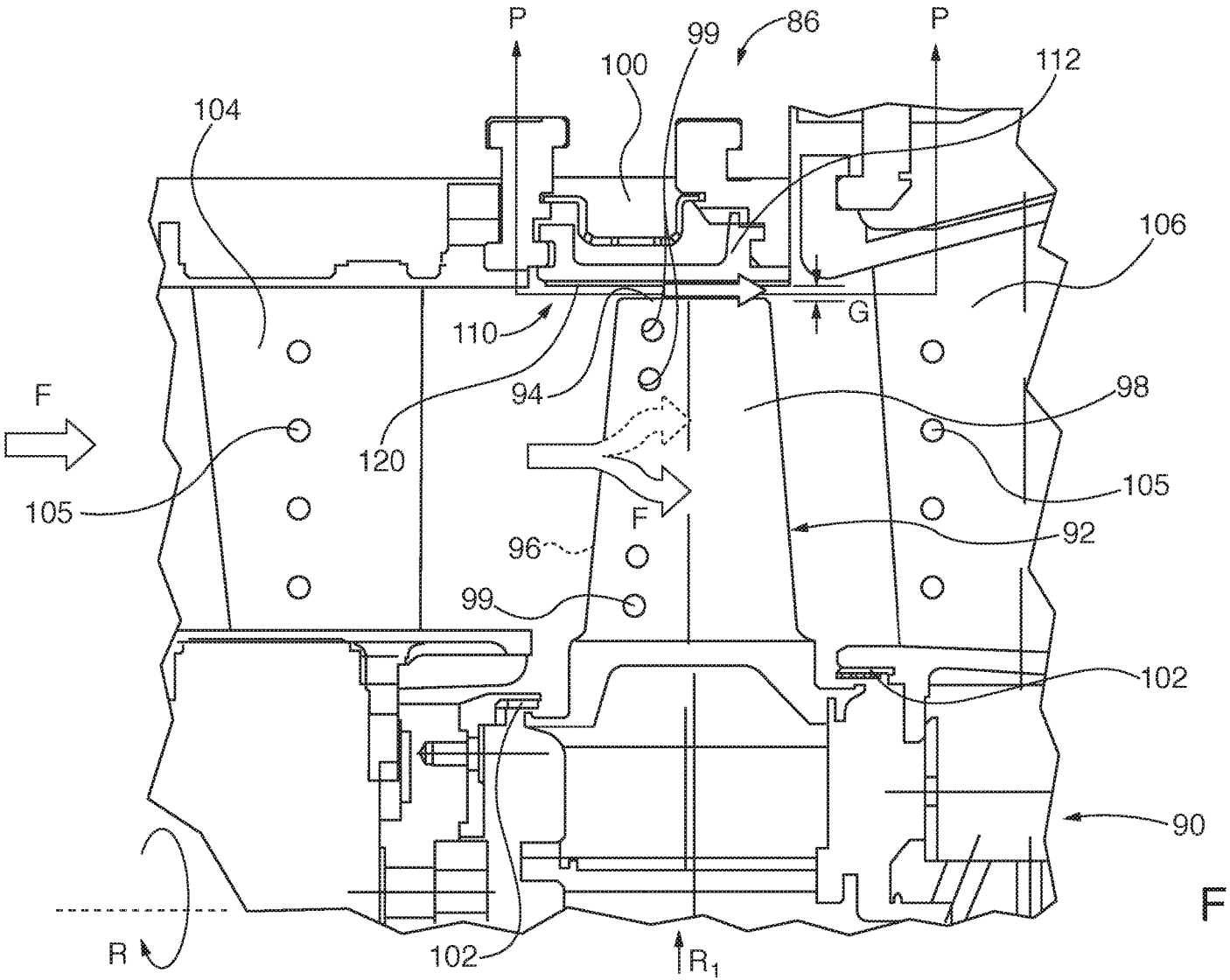
FIG. 2 is a detailed cross sectional elevational view of the turbine engine of FIG. 1, showing Row 1 turbine blade and Rows 1 and 2 vanes incorporating one or more exemplary thermal barrier coating embodiments of the invention.

General Summary of Thermally Sprayed TBC Application in Combustion Turbine Engine Components Referring to FIGS. 1-2, turbine engines, such as the gas or combustion turbine engine 80 include a multi stage compressor section 82, a combustion section 84, a multi stage turbine section 86 and an exhaust system 88. Atmospheric pressure intake air is drawn into the compressor section 82 generally in the direction of the flow arrows F along the axial length of the turbine engine 80. The intake air is progressively pressurized in the compressor section 82 by rows rotating compressor blades and directed by mating compressor vanes to the combustion section 84, where it is mixed with fuel and ignited. The ignited fuel/air mixture, now under greater pressure and velocity than the original intake air, is directed through a transition 85 to the sequential blade rows $R_1$, $R_2$, etc., in the turbine section 86. The engine's rotor and shaft 90 has a plurality of rows of airfoil cross sectional shaped turbine blades 92 terminating in distal blade tips 94 in the compressor 82 and turbine 86 sections. For convenience and brevity further discussion of thermal barrier coat (TBC) layers on the engine components will focus on the turbine section 86 embodiments and applications, though similar constructions are applicable for the compressor 82 or combustion 84 sections, as well as for steam turbine engine components. In the engine's 80 turbine section 86, each turbine blade 92 has a concave profile high pressure side 96 and a convex low pressure side 98. Cooling holes 99 that are formed in the blade 92 facilitate passage of cooling fluid along the blade surface. The high velocity and pressure combustion gas, flowing in the combustion flow direction F imparts rotational motion on the blades 92, spinning the rotor. As is well known, some of the mechanical power imparted on the rotor shaft is available for performing useful work. The combustion gasses are constrained radially distal the rotor by turbine casing 100 and proximal the rotor by air seals 102 comprising abradable surfaces. Referring to the Row 1 section shown in FIG. 2, respective upstream vanes 104 and downstream vanes 106 respectively direct upstream combustion gas generally parallel to the incident angle of the leading edge of turbine blade 92 and redirect downstream combustion gas exiting the trailing edge of the blade for a desired entry angle into downstream Row 2 turbine blades (not shown). Cooling holes 105 that are formed in the vanes 104, 106 facilitate passage of cooling fluid along the vane surface. It is noted that the cooling holes 99 and 105 shown in FIG. 2 are merely schematic representations, are enlarged for visual clarity and are not drawn to scale. A typical turbine blade 92 or vane 104, 106 has many more cooling holes distributed about the respective airfoil bodies of much smaller diameter relative to the respective blade or vane total surface area that is exposed to the engine combustion gas.

As previously noted, turbine component surfaces that are exposed to combustion gasses are often constructed with a thermal barrier coating (TBC) layer for insulation of their underlying substrates. Typical TBC coated surfaces include the turbine blades 92, the vanes 104, 106 and related turbine vane carrier surfaces and combustion section transitions 85. The TBC layer for blade 92, vane 104, 106 and transition 85 exposed surfaces are often applied by thermal sprayed or vapor deposition or solution/suspension plasma spray methods, with a total TBC layer thickness of 300-2000 microns (μm).

Turbine Blade Tip Abradable Component TBC Application

Insulative layers of greater thickness than 1000 microns are often applied to sector shaped turbine blade tip abradable components 110 (hereafter referred to generally as an "abradable component") that line the turbine engine 80 turbine casing 100 in opposed relationship with the blade tips 94. The abradable components 110 having a support surface 112 retained within and coupled to the casing and an insulative abradable substrate 120 that is in opposed, spaced relationship with the blade tip by a blade tip gap G. The abradable substrate is often constructed of a metallic/ceramic material, similar to the TBC coating materials that are applied to blade 92, vane 104, 106 and transition 85 combustion gas exposed surfaces. Those abradable substrate materials have high thermal and thermal erosion resistance and maintain structural integrity at high combustion temperatures. Generally, it should be understood that some form of TBC layer is formed over the blade tip abradable component 110 bare underlying metallic support surface substrate 112, for insulative protection, plus the insulative substrate thickness that projects at additional height over the TBC. Thus it should be understood that abradable components 110 have a functionally equivalent TBC layer to the TBC layer applied over the turbine transition 85, blade 92 and vane 102/104, The abradable surface 120 function is analogous to a shoe sole or heel that protects the abradable component support surface substrate 112 from wear and provides an additional layer of thermal protection. Exemplary materials used for blade tip abradable surface ridges/grooves include pyrochlore, fully cubic or partially stabilized yttria stabilized zirconia. As the abradable surface 120 metallic ceramic materials is often more abrasive than the turbine blade tip 94 material a blade tip gap G is maintained to avoid contact between the two opposed components that might at best cause premature blade tip wear and in worse case circumstances might cause engine damage.

Blade tip abradable components 110 are often constructed with a metallic base layer support surface 112, to which is applied a thermally sprayed ceramic/metallic abradable substrate layer 120 of many thousands of microns thickness, i.e., multiples of the typical transition 85 blade 92 or vane 104/106 TBC layer thickness. As will be described in greater detail herein, the abradable layer of exemplary turbine blade tip opposing abradable surface planform and projection profile invention embodiments described in the related patent applications for which priority is claimed herein include grooves, depressions or ridges in the abradable substrate layer 120 to reduce abradable surface material cross section for potential blade tip 94 wear reduction and for directing combustion airflow in the gap region G. Commercial desire to enhance engine efficiency for fuel conservation has driven smaller blade tip gap G specifications: preferably no more than 2 millimeters and desirably approaching 1 millimeter (1000 μm).

FIGS. 3-15 are a brief synopsis of exemplary turbine blade tip opposing abradable surface planform and projection profile invention embodiments described in the related patent applications for which priority is claimed herein. The abradable component cross sectional profiles shown in FIGS. 3-8 that are formed in the thermally sprayed or vapor deposited abradable layer comprise composite multi height/depth ridge and groove patterns that have distinct upper (zone I) and lower (zone II) wear zones. The abradable component cross sectional profiles shown in FIGS. 9-15 comprise pixelated major planform patterns (PMPP) of discontinuous micro surface features (MSF), over which is applied an abradable layer, so that the finished blade tip abradable layer 120 has aggregate planform and cross sectional patterns of ridge and groove patterns similar to those of the solid rib and groove constructions of FIGS. 3-8.

With respect to the FIG. 3-8 abradable surface patterns—again with ridges and grooves projecting multiple thousands of microns above the underlying substrate surface compared to 2000 or less TBC layer thickness on blade, vane or transition component combustion gas exposed surfaces—the lower wear zone II optimizes engine airflow and structural characteristics while the upper wear zone I minimizes blade tip gap and wear by being more easily abradable than the lower zone. Various embodiments of the abradable component afford easier abradability of the upper zone with upper sub ridges or nibs having smaller cross sectional area than the lower zone rib structure. In some embodiments the upper sub ridges or nibs are formed to bend or otherwise flex in the event of minor blade tip contact and wear down and/or shear off in the event of greater blade tip contact. In other embodiments the upper zone I sub ridges or nibs are pixelated into arrays of upper wear zones so that only those nibs in localized contact with one or more blade tips are worn while others outside the localized wear zone remain intact. In the event that the localized blade tip gap is further reduced, the blade tips wear away the zone II lower ridge portion at that location. However the relatively higher ridges outside that lower ridge portion localized wear area maintain smaller blade tip gaps to preserve engine performance efficiency.

With the progressive wear zones construction of some blade tip abradable wear surface 120 embodiments of the prior applications for which priority is claimed herein, blade tip gap G can be reduced from previously acceptable known dimensions. For example, if a known acceptable blade gap G design specification is 1 mm the higher ridges in wear zone I can be increased in height so that the blade tip gap is reduced to 0.5 mm. The lower ridges that establish the boundary for wear zone II are set at a height so that their distal tip portions are spaced 1 mm from the blade tip. In this manner a 50% tighter blade tip gap G is established for routine turbine operation, with acceptance of some potential wear caused by blade contact with the upper ridges in zone I. Continued localized progressive blade wearing in zone II will only be initiated if the blade tip encroaches into the lower zone, but in any event the blade tip gap G of 1 mm is no worse than known blade tip gap specifications. In some exemplary embodiments the upper zone I height is approximately ⅓ to ⅔ of the lower zone II height. If the blade tip gap G becomes reduced for any one or more blades due to turbine casing 100 distortion, fast engine startup mode or other reason initial contact between the blade tip 94 and the abradable component 10 will occur at the higher ridge tips forming Zone I. While still in zone I the blade tips 94 only rub the alternate staggered higher ridges. If the blade gap G progressively becomes smaller, the higher ridges will be abraded until they are worn all the way through zone I and start to contact the lower ridge tips in zone II. Once in Zone II the turbine blade tip 94 rubs all of the remaining ridges at the localized wear zone, but in other localized portions of the turbine casing there may be no reduction in the blade tip gap G and the upper ridges may be intact at their full height. Thus the alternating height rib construction of some of the abradable component 110 embodiments accommodates localized wear within zones I and II, but preserve the blade tip gap G and the aerodynamic control of blade tip leakage in those localized areas where there is no turbine casing 100 or blade 92 distortion.

Multi-height wear zone constructions in abradable components are also beneficial for so-called "fast start" mode engines that require faster full power ramp up (order of 40-50 Mw/minute). Aggressive ramp-up rates exacerbate potential higher incursion of blade tips into ring segment abradable coating 120, resulting from quicker thermal and mechanical growth and higher distortion and greater mismatch in growth rates between rotating and stationary components. When either standard or fast start or both engine operation modes are desired the taller ridges Zone I form the primary layer of clearance, with the smallest blade tip gap G, providing the best energy efficiency clearance for machines that typically utilize lower ramp rates or that do not perform warm starts. Generally the ridge height for the lower ridge tips in Zone II is between 25%-75% of the higher ridge tip height of those forming Zone I.

Figure 3:
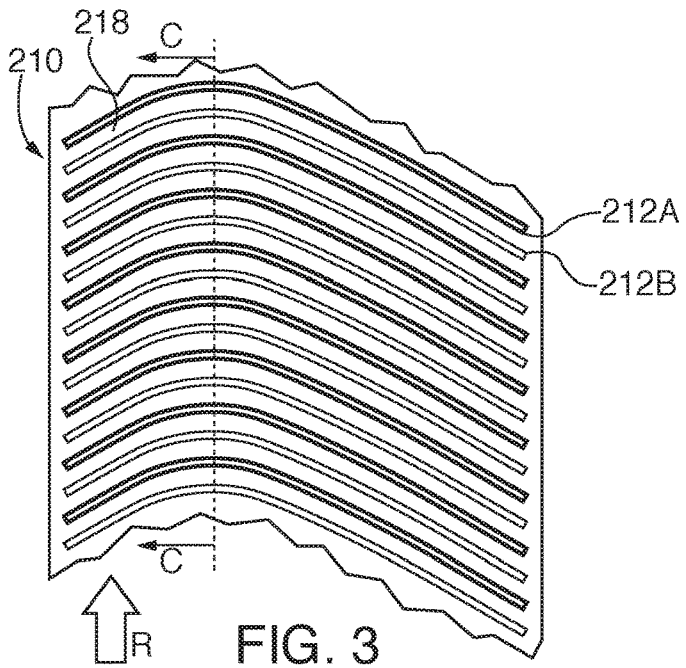
FIG. 3 is a plan or plan form view of a multi height or elevation ridge profile configuration and corresponding groove pattern for a turbine blade tip abradable surface, suitable for use in either standard or "fast start" engine modes.
Figure 4:
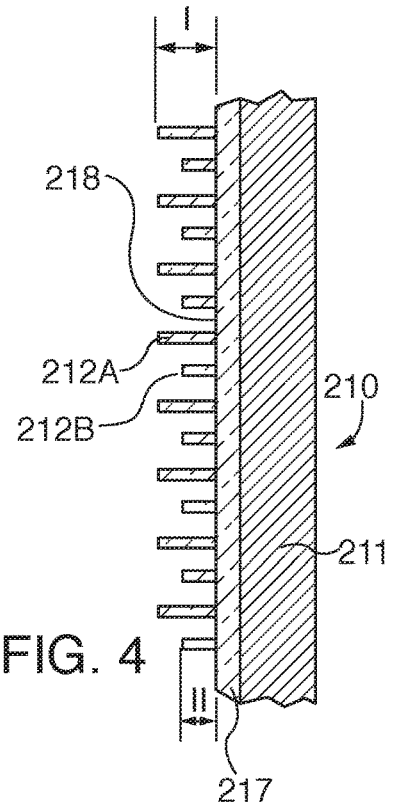
FIG. 4 is a cross sectional view of the turbine blade tip abradable surface embodiment of FIG. 3, taken along C-C thereof.

More particularly, FIGS. 3 and 4 show a blade tip abradable component 210 with curved planform, dual height profile ridges 212A, 212B that are separated by grooves 218. The ridges 212A/B are formed above surface height of an outer surface of a thermally sprayed ceramic/metallic TBC layer 217 that is applied over the turbine component metallic substrate 211. Generally, with reference to FIGS. 3-8 it should be understood that some form of TBC layer is formed over the bare underlying metallic substrate for the latter's insulative protection. In the case of FIG. 3, the abradable component ridges 212A, 212B project at additional height over the TBC layer 217. Thus it should be understood that abradable components, such as 210, 220 (FIG. 5), 230 (FIGS. 6 and 240 (FIG. 7) have a functionally equivalent TBC layer to the TBC layer applied over the turbine transition 85, blade 92 and vane 102/104, plus the additional thickness of the ridge and groove forming abradable layer (which often comprises similar materials of the TBC layer). In FIGS. 3 and 4, the ridges 212 A/B and grooves 218 in the sprayed metallic/ceramic abradable layer have been deposited and formed into three-dimensional ridge and groove profiles by known deposition or ablative material working methods. A convenient way to form the abradable component 210 abradable surface profile or any of the other profiles shown herein is to cut grooves into a flat surfaced thicker abradable substrate blank surface.

Figure 5:
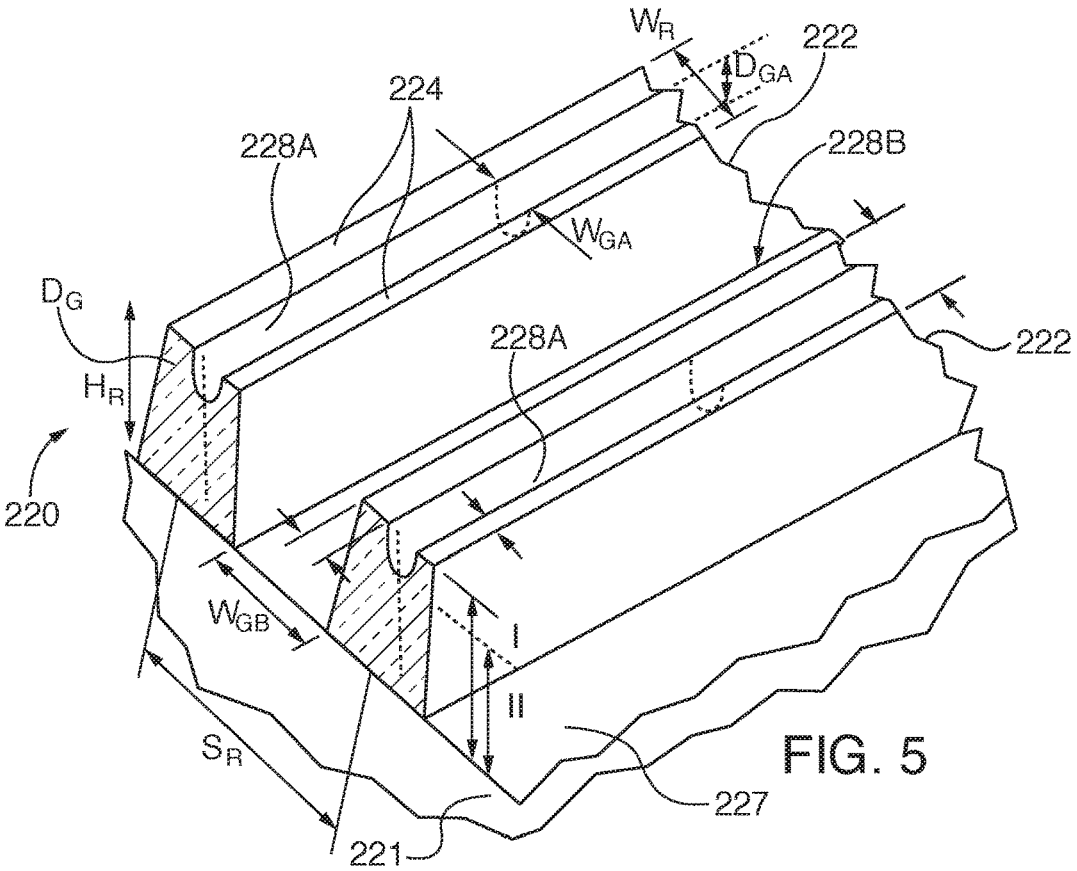
FIG. 5 is; a perspective view of a turbine blade tip abradable surface with an asymmetric profile ridge configuration and multi depth parallel groove profile pattern.

Progressive wear zones in abradable component surfaces 120 of the embodiments of FIGS. 5-8 can be incorporated in asymmetric ribs or any other rib profile by cutting grooves into the ribs, so that remaining upstanding rib material flanking the groove cut has a smaller horizontal cross sectional area than the remaining underlying rib. Groove orientation and profile may also be tailored to enhance airflow characteristics of the turbine engine by reducing undesirable blade tip leakage. FIG. 5 shows an abradable component 220 that includes dual level grooves, with grooves 228A formed in the ridge tips 222/224 and grooves 228B formed between the ridges 222/224 to the thinner layer of the TBC material covering the base substrate surface 227. The upper grooves 228A form shallower depth $D_{GA}$ lateral ridges that comprise the wear zone I while the remainder of the ridge 222 or 224 below the upper groove depth comprises the lower wear zone II.

Figure 6:
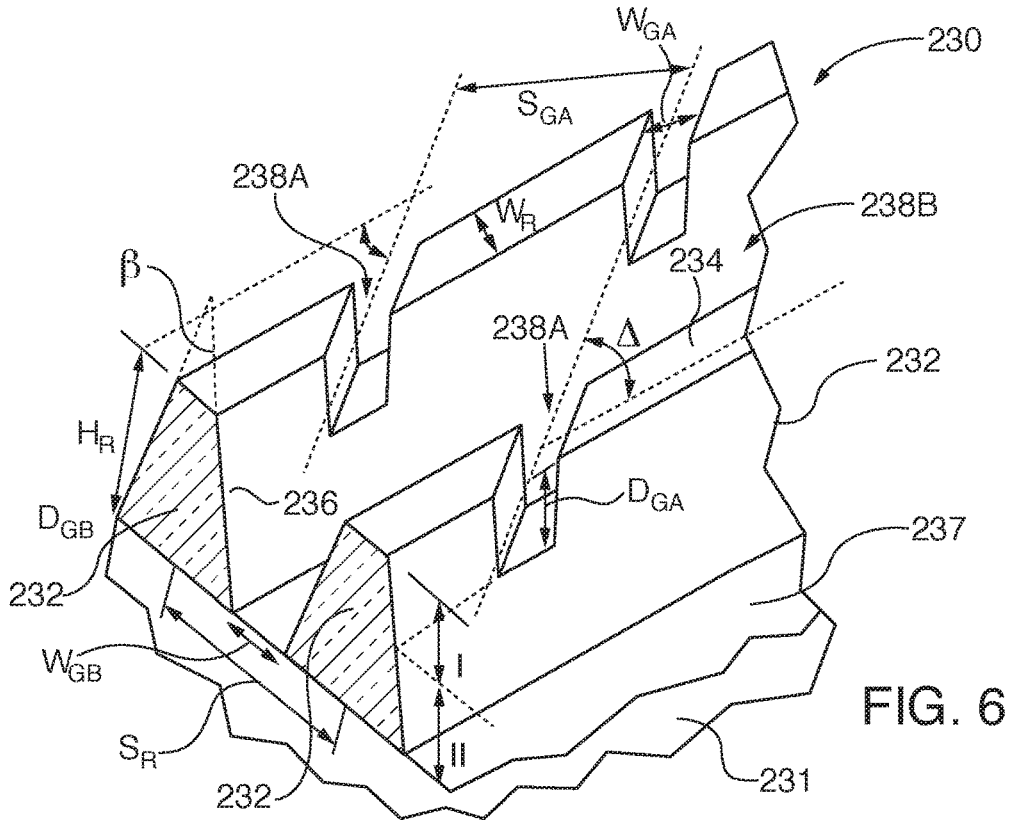
FIG. 6 is a perspective view of another embodiment of a turbine blade tip abradable surface with an asymmetric and multi depth intersecting groove profile pattern, wherein upper grooves are normal to and skewed axially/longitudinally relative to the ridge tip.

In the turbine blade tip abradable component 230 embodiment of FIG. 6 a plurality of upper grooves 238A are skewed at angle Δ relative to the ridge tips 234 of the ridges 232. The upper wear zone I is above the groove depth $D_{GA}$ and wear zone II is below that groove depth down to the outer surface of the TBC layer that insulates the underlying metallic body of the substrate 237. The upper groove 388A as shown is also normal to the ridge tip 384 surface.

Figure 7:
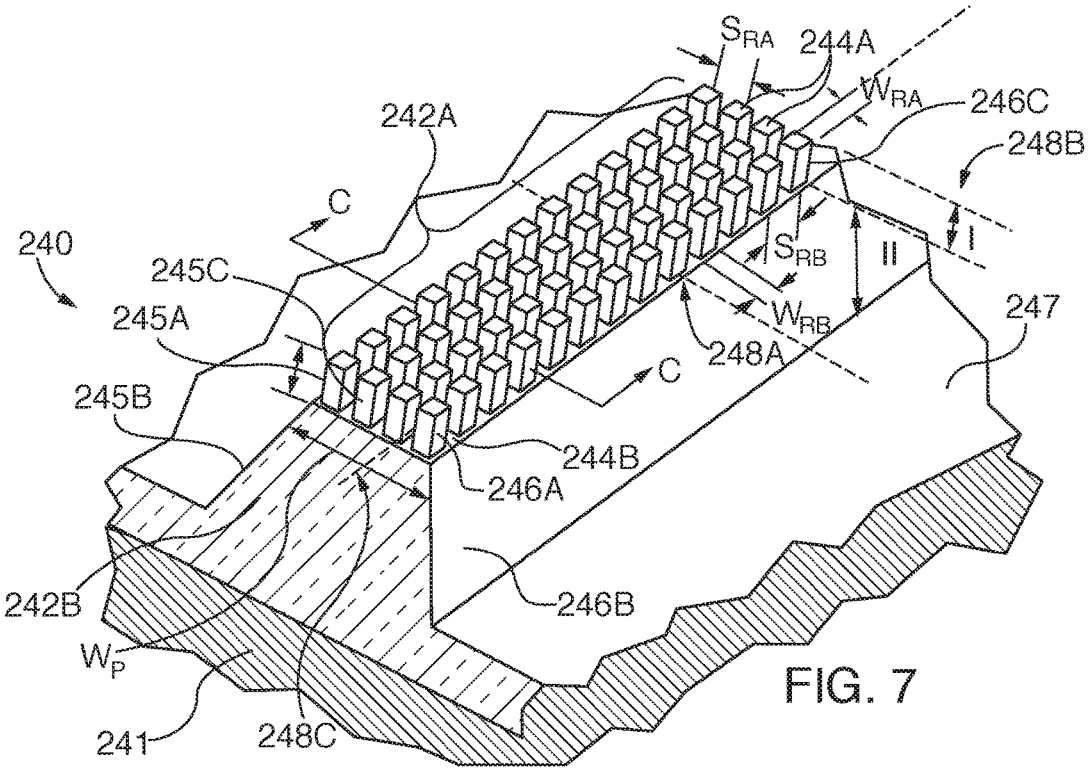
FIG. 7 is a perspective view of a stepped profile turbine blade tip abradable surface ridge, wherein the upper level ridge has an array of pixelated upstanding nibs projecting from the lower ridge plateau.
Figure 8:
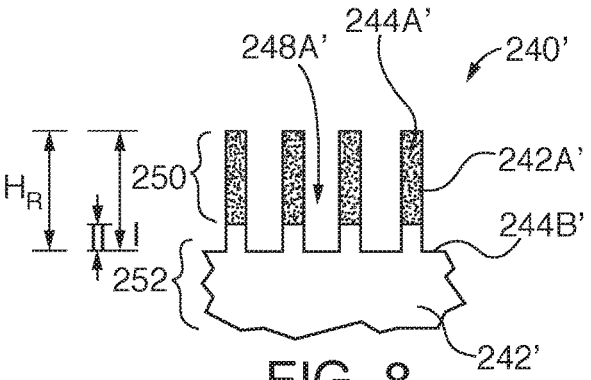
FIG. 8 is an alternate embodiment of the upstanding turbine blade tip abradable surface nibs of FIG. 7, wherein respective nib portions proximal the nib tips are constructed of a layer of material having different physical properties than the material below the layer.

With thermally sprayed blade tip abradable component construction, the cross sections and heights of upper wear zone I thermally sprayed abradable material can be configured to conform to different degrees of blade tip intrusion by defining arrays of micro ribs or nibs, as shown in FIGS. 7 and 8, on top of ridges. The abradable component 240 includes a previously described metallic support surface 241, insulated with a TBC surface layer. Arrays of lower grooves and ridges forming a lower wear zone II. Specifically the lower ridge 242B has side walls 245B and 246B that terminate in a ridge plateau 244B. Lower grooves 2488B are defined by the ridge side walls 245B and 246B and the substrate TBC layer outer surface covering the substrate 247. Pixelated micro ribs or nibs 242A are formed on the lower ridge plateau 244B by known additive processes or by forming an array of intersecting grooves 248A and 248C within the lower ridge 242B. In the embodiment of FIG. 7 the nibs 242A have square or other rectangular cross section, defined by upstanding side walls 245A, 245C, 246A and 246C that terminate in ridge tips 244A of common height. Other pixelated nib 242A cross sectional planform shapes can be utilized, including by way of example trapezoidal or hexagonal cross sections. Nib arrays including different localized cross sections and heights can also be utilized.

In the alternative embodiment of FIG. 8, distal rib tips 244A' of the upstanding pixelated nib 242A' are constructed of thermally sprayed material 250 having different physical properties and/or compositions than the lower thermally sprayed material 252. For example, the upper distal material 250 can be constructed with easier or less abrasive abrasion properties (e.g., softer or more porous or both) than the lower material 252. In this manner the blade tip gap G can be designed to be less than used in previously known abradable components to reduce blade tip leakage, so that any localized blade intrusion into the material 250 is less likely to wear the blade tips, even though such contact becomes more likely. In this manner the turbine engine can be designed with smaller blade tip gap, increasing its operational efficiency, as well as its ability to be operated in standard or fast start startup mode, while not significantly impacting blade wear.

Pixelated nib 242A and groove 248A/C dimensional boundaries are identified in FIGS. 7 and 8, consistent with those described in the prior embodiments. Generally nib 242A height $H_{RA}$ ranges from approximately 20%-100% of the blade tip gap G or from approximately ⅓-⅔ the total ridge height of the lower ridge 242B and the nibs 242A. Nib 242A cross section ranges from approximately 20% to 50% of the nib height $H_{RA}$.

Generally, the upper wear zone I ridge height in the abradable component can be chosen so that the ideal blade tip gap is 0.25 mm. The 3:00 and 9:00 turbine casing circumferential wear zones are likely to maintain the desired 0.25 mm blade tip gap throughout the engine operational cycles, but there is greater likelihood of turbine casing/abradable component distortion at other circumferential positions. The lower ridge height may be selected to set its ridge tip at an idealized blade tip gap of 1.0 mm so that in the higher wear zones the blade tip only wears deeper into the wear zone I and never contacts the lower ridge tip that sets the boundary for the lower wear zone II. If despite best calculations the blade tip continues to wear into the wear zone II, the resultant blade tip wear operational conditions are no worse than in previously known abradable layer constructions. However in the remainder of the localized circumferential positions about the abradable layer the turbine is successfully operating with a lower blade tip gap G and thus at higher operational efficiency, with little or no adverse increased wear on the blade tips.

In the blade tip abradable embodiments of FIGS. 9-15, the abradable component includes a metallic support surface for coupling to a turbine casing and a thermally sprayed ceramic/metallic abradable substrate coupled to the support surface, which includes an insulative TBC layer applied over the entire support surface. An elongated pixelated major planform pattern (PMPP) comprising a plurality of discontinuous micro surface features (MSF) project from the metallic substrate surface and its insulative TBC layer across a majority of the circumferential swept path from a tip to a tail of the turbine blade. In some exemplary embodiments the PMPP aggregate planform mimics the general planform of the solid protruding rib abradable components of FIGS. 3-8. The PMPP repeats radially along the swept path in the blade tip rotational direction, for selectively directing airflow between the blade tip and the substrate surface. Each MSF is defined by a pair of first opposed lateral walls defining a width, length and height that occupy a volume envelope of 1-12 cubic millimeters. In some embodiments the ratio of MSF length and gap defined between each MSF is in the range of approximately 1:1 to 1:3. In other embodiments the ratio of MSF width and gap is in the range of approximately 1:3 to 1:5. In some embodiment the ratio of MSF height to width is approximately 0.5 to 1.0. Feature dimensions can be (but not limited to) between 1 mm and 3 mm, with a wall height of between 0.1 mm to 2 mm and a wall thickness of between 0.2 mm and 1 mm. In some embodiments the PMPP has first height and higher second height MSFs.

The MSFs in the PMPPs of some embodiments are generated from a cast in or an engineered surface feature formed directly in the substrate material. In other embodiments the MSFs in the PMPPs are generated in the substrate or in an overlying bond coat (BC) layer by an ablative or additive surface modification technique such as water jet or electron beam or laser cutting or by laser sintering methods. The engineered surface features are subsequently coated with high temperature abradable thermal barrier coating (TBC), with or without an intermediate bond coat layer applied on the engineered MSF features in the PMPP, to produce a discontinuous surface that will abrade more efficiently than a current state of the art coating. Once contacted (by a passing blade tip), released (abraded) particles are removed via a tortuous, convoluted (above or subsurface) path in gaps between the MSFs or additional slots formed within the abradable surface between the MSFs. Optional continuous slots and/or gaps are oriented so as to provide a tortuous path for hot gas ejection, thereby maintaining the sealing efficiency of the primary (contact) surface. The surface configuration, which reduces potential rubbing contact surface area between the blade tips and the discontinuous MSFs, reduces frictional heat generated in the blade tip. Reduced frictional heat in the blade tip potentially reduces worn blade tip material loss attributable to tip over heating and metal smear/transfer onto the surface of the abradable. Further benefits include the ability to deposit thicker, more robust thermal barrier coatings over the MSFs than normally possible with known continuous abradable rib designs, thereby imparting potentially extended design life for ring segments.

The micro surface feature (MSF) in its simplest form can be basic shape geometry, repeated in unit cells across the surface of the ring segment with gaps between respective cells. The unit cell MSFs are analogous to pixels that in aggregate forms the PMPP's larger pattern. In more optimized forms the MSF can be modified according to the requirement of the blade tip relationship of the thermal behavior of the component during operation. In such circumstances, feature depth, orientation, angle and aspect ratio may be modified within the surface to produce optimized abradable performance from beginning to end of blade sweep. Other optimization parameters include ability of thermal spray equipment that forms the TBC to penetrate fully captive areas within the surface and allow for an effective continuous TBC coating across the entire surface.

As previously noted, the abradable component with the PMPPs comprising arrays of MSFs is formed by casting the MSFs directly into the abradable substrate during its manufacture or built up on the substrate (such as by thermal spray or additive manufacturing techniques, e.g., electron beam or laser beam deposition) or by ablation of substrate material. In the first-noted formation process, a surface feature can be formed in a wax pattern, which is then shelled and cast per standardized investment casting procedures. Alternatively, a ceramic shell insert can be used on the outside of the wax pattern to form part of the shell structure. When utilizing a ceramic shell insert the MSFs can be more effectively protected during the abradable component manufacture handing and can more exotic in feature shape and geometry (i.e., can contain undercuts or fragile protruding features that would not survive a normal shelling operation.

MSFs can be staggered (stepped) to accept and specifically deflect plasma splats for optimum TBC penetration. Surface features cast-in and deposited onto the substrate may not necessarily fully translate in form to a fully TBC coated surface. During coating, ceramic deposition will build upon the substrate in a generally transformative nature but will not directly duplicate the original engineered surface feature. The thermal spray thickness can also be a factor in determining final surface form. Generally, the thicker the thermal spray coating, the more dissipated the final surface geometry. This is not necessarily problematical but needs to be taking into consideration when designing the engineered surface feature (both initial size and aspect ratio. For example, a chevron-shaped MSF formed in the substrate, when subsequently coated by an intermediate bond coat layer and a TBC top layer may dissipate as a crescent- or mound-shaped protrusion in the finished abradable surface projecting profile.

Where exemplary MSF unit cells are shown in FIGS. 9-15, these are provided for dimensional considerations. For effective dimensional guidance, the unit cell size can be considered a cube ranging from 1 mm to 12 mm in size. Variations on the cube dimensions can also be applied to cell height. This can be either smaller or larger than the cube size depending upon the geometry of the feature and the thickness of coating to be applied. Typically the size range of this dimension can be between 1 mm and 10 mm.

Various exemplary embodiments described herein, which incorporate pixelated major planform patterns (PMPP) of discontinuous micro surface features (MSF) jointly or severally in different combinations have at least some of the following features:

- The MSF engineered surface features improve the adhesion and mechanical interlocking properties of the plasma sprayed the abradable coating, due to increased bonding surface area and the uniqueness of the surface features to interlock the coating normal to the surface via various interlocking geometries that have been described herein.
- Due to reduced abradable surface contact area with turbine blade tips, relatively more expensive coatings that are more abradable than standard cost 8YSZ thermal barrier coating material, such as 33YBZO (33% $Yb_2O_3$-Zirconia) or Talon-type YSZ (high porosity YSZ co-sprayed with polymer) are not needed. The less abradable (i.e., harder) YSZ wearing of blade tips is negated by the smaller surface area potential rubbing contact with the rotating blade tips.
- The micro surface features (MSF)—some as small as 100 microns (μm) in height—reduce potential thermal barrier coating spallation, due to the increased adhesion surface contact area with the overlying thermal barrier coating.

Figure 9:
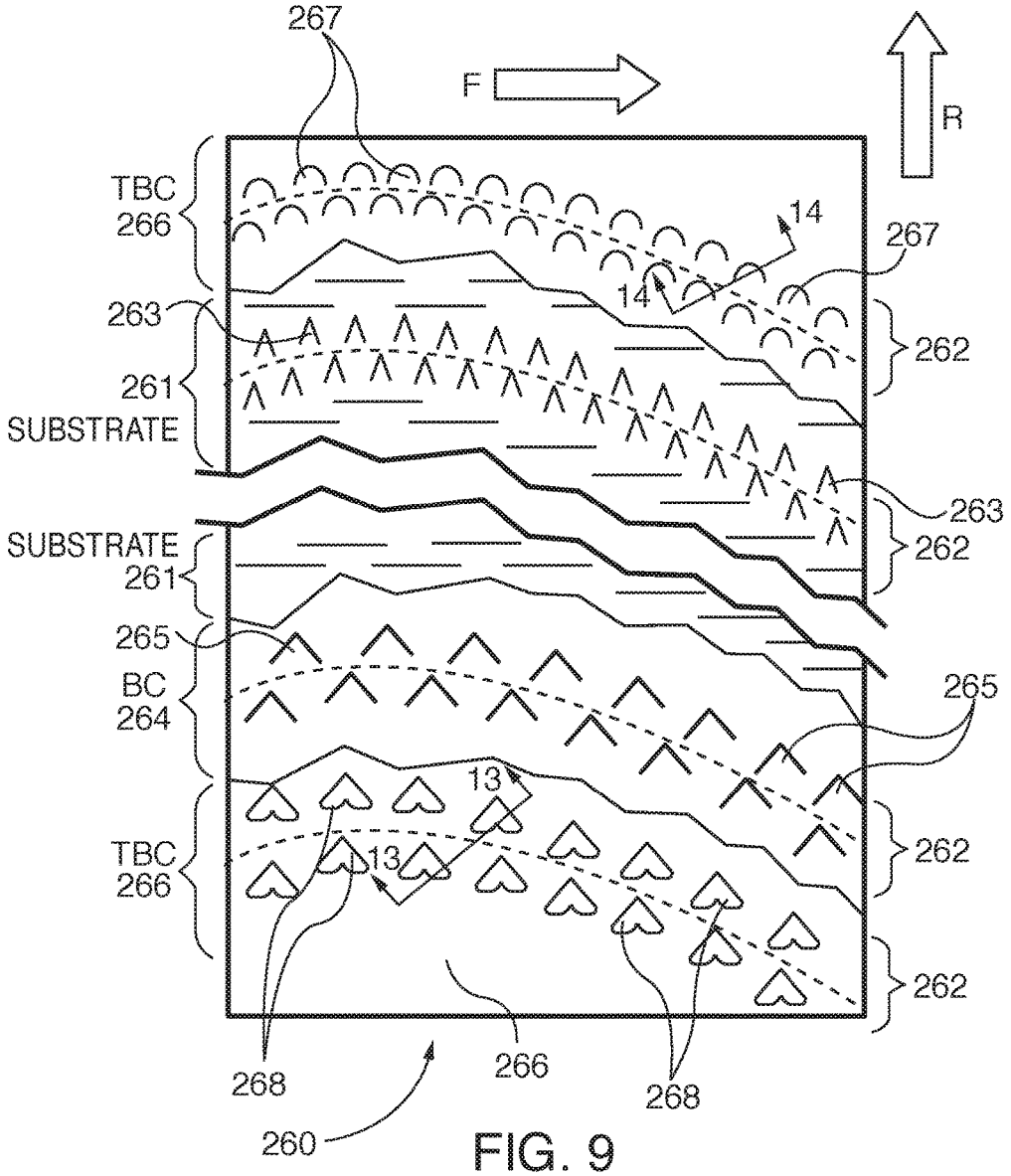
FIG. 9 is a plan or planform view of peeled layers of a turbine blade tip abradable component with a curved elongated pixelated major planform pattern (PMPP) of a plurality of micro surface features (MSFs)

Exemplary embodiments of turbine abradable components including pixelated major planform patterns (PMPP) of discontinuous micro surface features (MSF) are shown in FIGS. 9-15. For drawing simplicity the FIG. 9 shows schematically PMPPs comprising two rows of MSFs. However, one or more of the PMPPs in any abradable component can comprise a single row or more than two rows of MSFs. For example, FIG. 9 is a planform schematic view of an abradable component 260 split into upper and lower portions, having a metallic substrate 261. On the upper portion above the split the substrate 261 has a curved overall profile pixelated major planform pattern (PMPP) 262 comprising an array of chevron-shaped micro surface features (MSF) 263 formed directly on the substrate. As previously described the MSFs 263 are formed by any one or more of a casting process that directly creates them during the substrate initial formation; an additive process, building MSFs on the previously formed substrate 261 surface; or by an ablative process that cuts or removes metal from the substrate, leaving the formed MSFs in the remaining material.

On the uppermost portion of the abradable component 260 a thermal barrier coating (TBC) 266 has been applied directly over the MSFs 263, leaving mound or crescent-shaped profile projections 267 on the abradable component in a PMPP 262 that are arrayed for directing hot gas flow between the abradable component and a rotating turbine blade tip. In the event of contact between the blade tip and the opposing surface of the abradable component 260 the relatively small cross sectional surface area MSFs 263 will rub against and be abraded by the blade tip. The MSF 263 and turbine blade tip contact is less likely to cause blade tip erosion or spallation of the abradable surface 260 from the contact, compared to previously known continuous single height or solid surface abradable components that do not have the benefit of the abradable upper and lower Zones I and II, such as those shown in FIGS. 3-8.

On the lowermost portion of the abradable component 260 a metallic bond coat (BC) 264 is applied to the naked metallic substrate 261 and the chevron-shaped MSFs 265 are formed in the BC by additive or ablative manufacturing processes. The BC 264 and the MSFs 265, arrayed in the PMPP 262, are then covered with a TBC 266 leaving generally chevron-shaped MSFs 268 that project from the substrate 260 surface.

Figure 10:
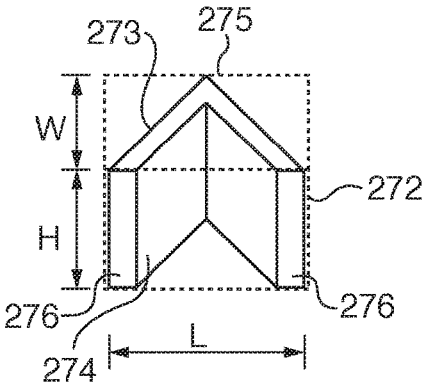
FIG. 10 is a detailed perspective view of a chevron-shaped micro surface feature (MSF) of the abradable component of FIG. 9.

Dimensions of an exemplary chevron-shaped MSF 272 are shown in FIG. 10. The chevron-shaped MSFs 272, having closed continuous leading edges 273, trailing edges 274, top surfaces 275 facing the rotating turbine blades. Staggered rows of chevrons 272 create a tortuous path for hot gas flow. Each chevron shaped MSF embodiment 272 has width W, length L and Height H dimensions that occupy a volume envelope of 1-12 cubic millimeters. In some embodiments the ratio of MSF length and gap defined between each MSF is approximately in the range of 1:1 to 1:3. In other embodiments the ratio of MSF width and gap is approximately 1:3 to 1:8. In some embodiment the ratio of MSF height to width is approximately 0.5 to 1.0. Feature dimensions can be (but not limited to) between 3 mm and 10 mm, with a wall height and/or wall thickness of between 100-2000 microns (μm).

Figure 12:
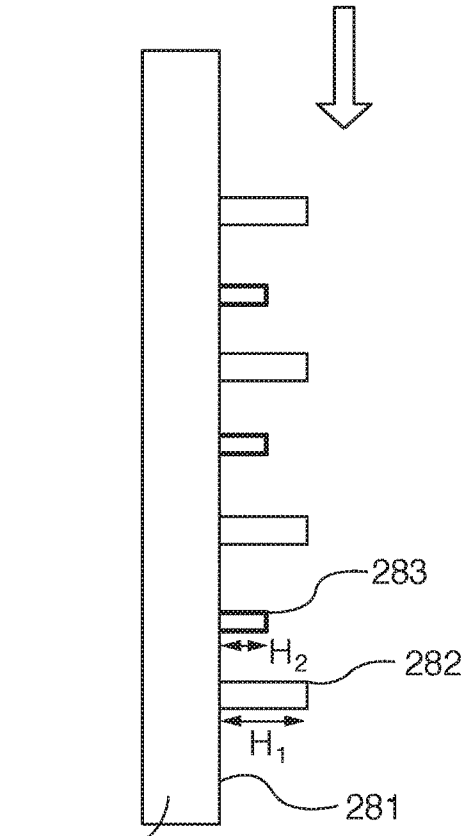
FIG. 12 is a cross sectional view of the turbine blade tip abradable component of FIG. 11, taken along C-C thereof.
Figure 11:
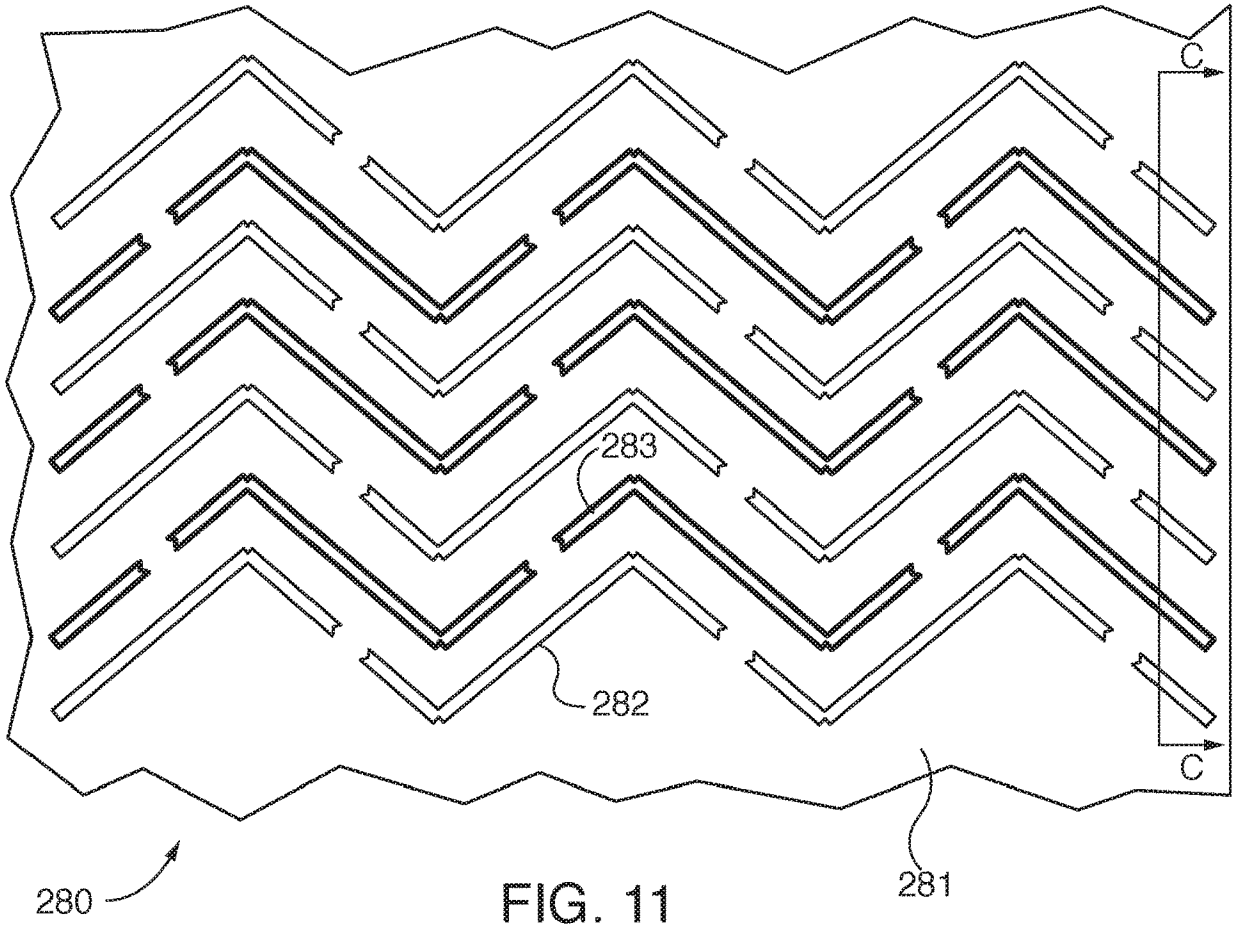
FIG. 11 is a fragmented plan or planform view showing a turbine blade tip abradable component surface with a zig-zag undulating pixelated major planform pattern (PMPP) of first height and higher second height micro surface features (MSFs)

As with the blade tip abradable components embodiments shown in FIGS. 3-8, MSF heights can be varied within the PMPP for facilitating both fast and normal start modes in a turbine engine with a common abradable component profile. In FIGS. 11-12 the abradable component 280 has dual height chevron-shaped MSF arrays in their PMPPs, with respective taller height $H_1$ and lower height $H_2$, which is comparable to the Zone I and Zone II ridge heights in the previously described solid rib embodiments. The abradable component 280 utilizes staggered height discontinuous patterns of Z-shaped MSFs 282 and 283 on the surface 281.

Figure 13:
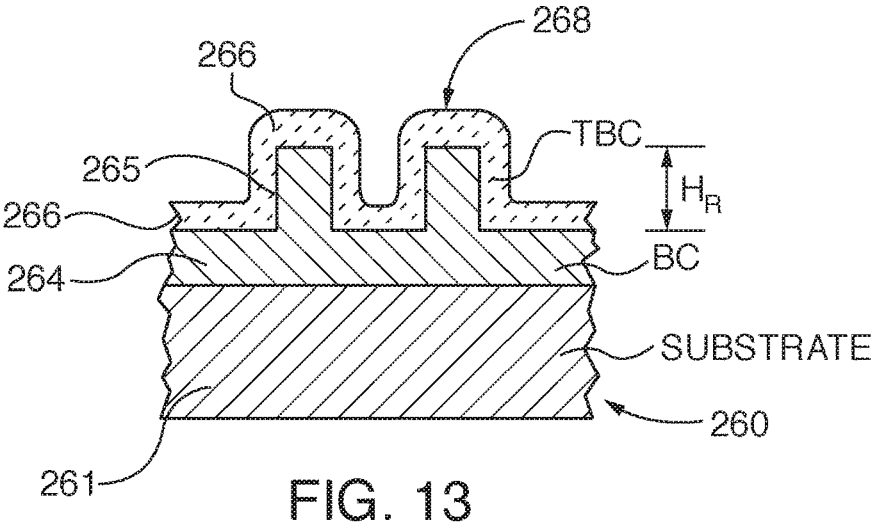
FIG. 13 is a cross sectional view of a turbine blade tip abradable component with micro surface features (MSF) formed in a metallic bond coat that is applied over a support substrate, taken along 13-13 of FIG. 9.
Figure 14:
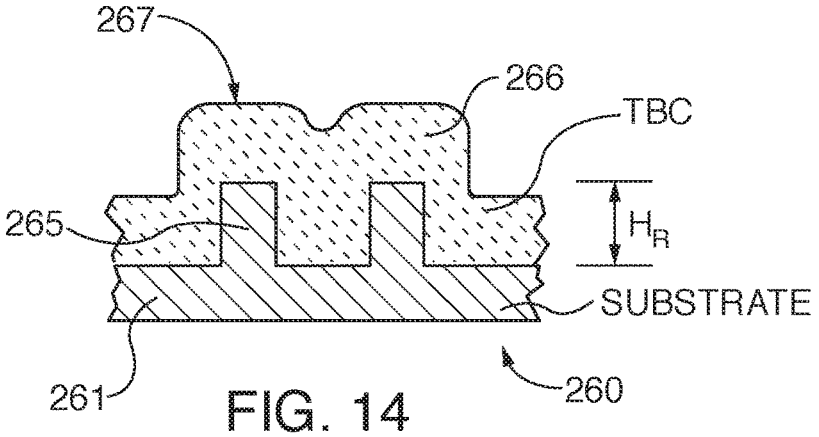
FIG. 14 is a cross sectional view of a turbine blade tip abradable component with micro surface features (MSF) formed in a support substrate, taken along 14-14 of FIG. 9.
Figure 15:
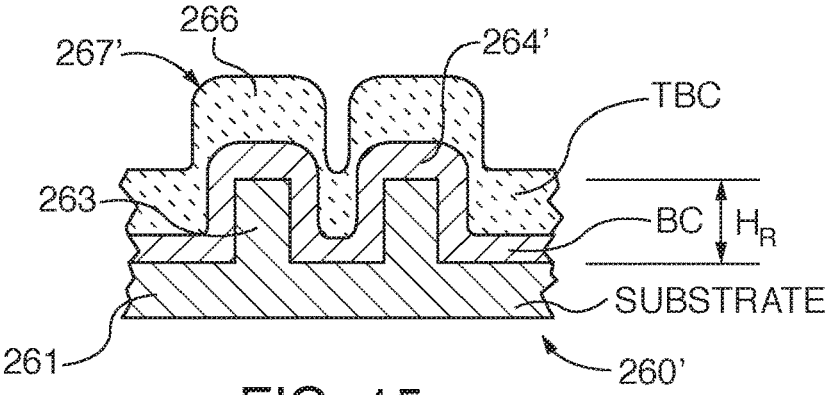
FIG. 15 is an alternate embodiment of the abradable tip component of FIG. 14, having a metallic bond coat (BC) applied as an intermediate layer between the substrate and the TBC.

As previously discussed, the micro surface features MSFs can be formed in the substrate or in a bond coat of an abradable component. In FIG. 13 the cross section of the abradable component 260 shows a smooth, featureless substrate 261 over which has been applied a bond coat (BC) layer 264, into which has been formed the MSFs 265 by any one or more of the additive or ablative processes previously described. The sprayed thermal barrier coating (TBC) 266 has been applied over the BC 264, including the MSFs 265, resulting in the generally chevron-shaped MSFs 268. As shown in FIG. 14, the TBC layer 266 alternatively can be applied directly to an underlying substrate 260 and its engineered surface MSFs 265 without an intermediate BC layer, resulting in the mound or crescent-shaped profile projections 267. In another alternative embodiment of FIG. 15 the abradable component 260' substrate 261 has the engineered surface features 263, which can be formed by direct casting during substrate fabrication, ablative or additive processes, as previously described. In this example a bond coat 264' has been applied over the substrate 261 including the engineered feature MSFs 263. The BC 264' is subsequently covered by a TBC layer 266, resulting in the mound or crescent-shaped profile projections 267'. In each of the PMPP abradable embodiment cross sections of FIGS. 13-15, the MSF height is between approximately 100-2000 microns (μm). As previously noted, the MSFs 263 or 265 can aid mechanical interlocking of the TBC to the underlying BC or substrate layer.

Engineered Surface Features (ESFs) Enhance TBC Adhesion and Crack Isolation

Some exemplary turbine component embodiments incorporate an anchoring layer of engineered surface features (ESFs) that aid mechanical interlocking of the TBC layer and aid in isolation of cracks in the TBC layer, so that they do not spread beyond the ESF. In some blade tip abradable applications the solid ridge and groove projecting surface features as well as MSFs function as ESFs, depending upon the former's physical dimensions and relative spacing between them, but they are too large for more general application to turbine components other than blade tip abradable components. For exemplary turbine blade, vane or combustor transition applications the ESFs are formed in an anchoring layer that is coupled to an inner surface layer of the TBC layer and they are sized to anchor the TBC layer coating thickness range of 300-2000 microns (μm) applied to those components without changing an otherwise generally flat outer surface of the TBC layer that is exposed to combustion gas. Generally the ESFs have heights and three-dimensional planform spacing on the turbine component surface sufficient to provide mechanical anchoring and crack isolation within the total thickness of the TBC layer. Thus, the ESFs will be shorter than the total TBC layer thickness but taller than etched or engraved surface features that are allegedly provided to enhance adhesion bonding between the TBC and the adjoining lower layer (e.g., an underlying naked substrate or intermediate bond coat layer interposed between the naked substrate and the TBC layer). Generally, in exemplary embodiments the ESFs have a projection height between approximately 2-75 percent of the TBC layer's total thickness. In some preferred embodiments the ESFs have a projection height of at least approximately 33 percent of the TBC layer's total thickness. In some exemplary embodiments the ESFs define an aggregate surface area at least 20 percent greater than an equivalent flat surface area.

Figure 16:
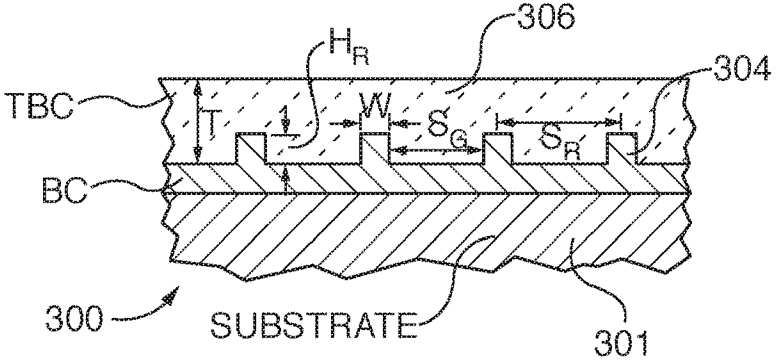
FIG. 16 is a fragmentary view of a turbine component, such as for example a turbine blade, vane or combustion section transition, having an exemplary embodiment of engineered surface features (ESFs) formed in a bond coat (BC) with the thermal barrier coat (TBC) applied over the ESFs.

FIGS. 16-19 show exemplary embodiments of engineered surface features (ESFs) formed in an anchoring layer that is coupled to an inner surface of the TBC layer. The TBC layer may comprise multiple layers of TBC material, but will ultimately have at least a thermal barrier coat (TBC) with an outer surface for exposure to combustion gas. In FIG. 16, the turbine component 300, for example a combustor section transition, a turbine blade or a turbine vane, has a metallic substrate 301 that is protected by an overlying thermal barrier coating (TBC). A bond coat (BC) layer 302 is built upon and applied over the otherwise featureless substrate 301, which incorporates a planform pattern of engineered surface features (ESFs) 304. Those ESFs 304 are formed directly in the BC by: (i) known thermal spray of molten particles to build up the surface feature or (ii) known additive layer manufacturing build-up application of the surface feature, such as by 3-D printing, sintering, electron or laser beam deposition or (iii) known ablative removal of substrate material manufacturing processes, defining the feature by portions that were not removed. The ESFs 304 and the rest of the exposed surface of the BC layer 302 may receive further surface treatment, for example surface roughening, micro engraving or photo etching processes to enhance adhesion of the subsequent thermally sprayed TBC layer 306. Thus, the ESFs 304 and the remaining exposed surface of the BC layer 302 comprise an anchoring layer for the TBC layer 306. The outer surface of the TBC layer 306 is exposed to combustion gas.

Figure 17:
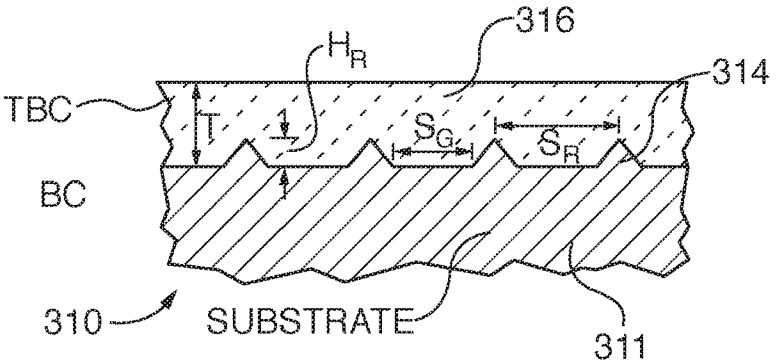
FIG. 17 is a fragmentary view of a turbine component, having an exemplary embodiment of engineered surface features (ESFs) formed directly in the substrate surface with the thermal barrier coat (TBC) applied over the ESFs.

In FIG. 17, the turbine component 310 has a metallic substrate 311 in which the planform pattern of engineered surface features (ESFs) 314 is formed directly in the otherwise featureless substrate 311 by known direct casting or build-up on the substrate surface by thermal spraying, additive layer build up or ablative removal of substrate material manufacturing processes that defines the feature by remaining portions of the substrate that were not removed. The ESFs 314 and the exposed surface of the naked substrate 311 may receive further surface treatment, for example surface roughening, micro engraving or photo etching processes to enhance adhesion of the subsequent thermally sprayed TBC layer 316. Thus, the ESFs 314 and the naked substrate surface comprise an anchoring layer for the TBC layer 316 without any intermediate BC layer.

Figure 18:
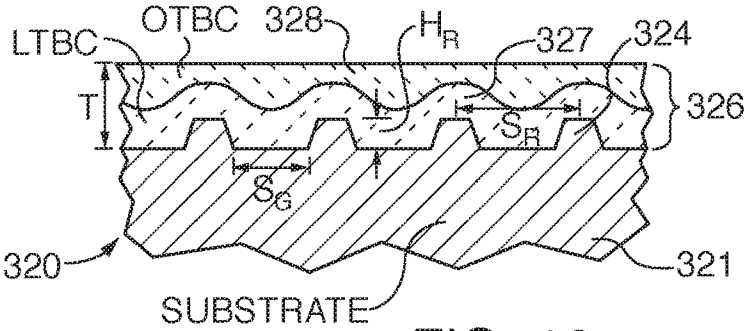
FIG. 18 is a fragmentary view of a turbine component, having an exemplary embodiment of engineered surface features (ESFs) formed directly in the substrate surface with a two layer TBC comprising a lower thermal barrier coat (LTBC) applied over the ESFs and an outer thermal barrier coat (OTBC) applied over the LTBC.
Figure 19:
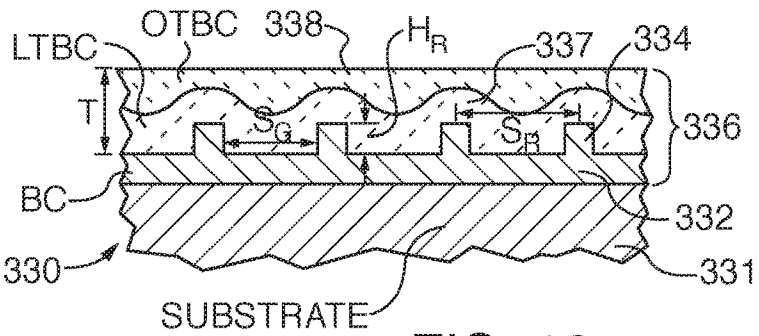
FIG. 19 is a fragmentary view of a turbine component, having an exemplary embodiment of engineered surface features (ESFs) formed in a bond coat (BC) with a two layer TBC comprising a lower thermal barrier coat (LTBC) applied over the ESFs and an outer thermal barrier coat (OTBC) applied over the LTBC.

In FIG. 18 turbine component 320 has a similar anchoring layer construction as the component 310 shown in FIG. 17, where the planform array of ESFs 324 are formed directly in the component metallic substrate 321, but a multi-layer TBC 326 is applied over the anchoring layer. The multi-layer TBC layer 326 comprises a lower thermal barrier coat (LTBC) 327 layer that is coupled to anchoring layer (in some embodiments the LTBC functions as a portion of the anchoring layer) and an outer thermal barrier coat (OTBC) layer that has an outer surface for exposure to combustion gas. Additional thermal barrier coat intermediate layers may be applied between the LTBC layer and the OTBC layer. Similarly the turbine component 330 of FIG. 19 also has a multi-layer TBC layer 336 that is applied over a bond coat (BC)-based anchoring layer. The BC layer 332 has a planform array of ESFs 334 formed therein, similar to the anchoring layer embodiment shown in FIG. 16. The TBC layer 336 includes an LTBC layer 337 and an OTBC layer 338 with an outer surface exposed to combustion gasses. As will be discussed in greater detail hereafter, multi-layer TBCs may comprise a series of sequentially applied layers having different material properties, such as strength, ductility, thermal resistivity or brittleness. Such material properties may be varied by application of a graded TBC layer, wherein different material constituents are thermally sprayed on the turbine component in different physical locations or as the TBC layer is built up during application.

Engineered surface feature (ESF) cross sectional profiles, their planform array patterns and their respective dimensions may be varied during design and manufacture of the turbine component to optimize thermal protection by inhibiting crack formation, crack propagation and TBC layer spallation. Different exemplary permutations of ESF cross sectional profiles their three-dimensional planform array patterns and their respective dimensions are shown in FIGS. 16-25. In these figures ESF height $H_R$, ESF ridge width W, ridge spacing $S_R$ and groove width between ridges $S_G$ are illustrated. In FIGS. 16, 19, 23 and 24 the respective ESFs 304, 334, 354 and 364 has rectangular or square cross sectional profiles. In FIG. 17 the ESFs 314 have a generally triangular cross sectional profile while in FIG. 18 the ESFs have a trapezoidal cross sectional profile with a pair of first opposed, inwardly sloping lateral walls terminating in a plateau. In the turbine component 370 of FIG. 25, the ESFs 374 formed in the BC 372 are angled relative to the underlying metallic substrate 371 surface for additional undercut mechanical anchoring of the TBC layer 376. It is also noted that additional anchoring capability can be achieved by applying a rough bond coat (RBC) layer over the anchoring layer surface, such as the RBC layer 365 of the turbine component 360 shown in FIG. 24. While the RBC 364 is shown applied over the BC 362 and its ESFs 364, it or other types of bond coats can also be applied directly over the component's metallic substrate 361.

Figure 20:
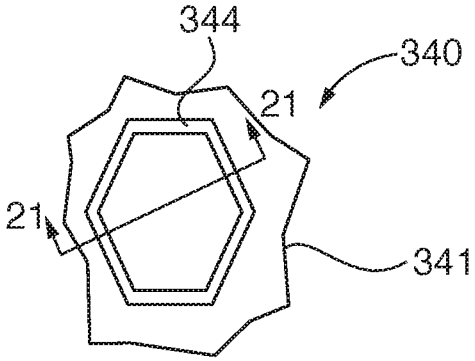
FIG. 20 is a fragmentary view of an exemplary embodiment turbine component having hexagonal planform profile of solid projection engineered surface features (ESFs) on its substrate surface.
Figure 21:
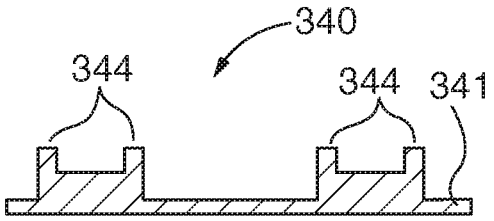
FIG. 21 is a cross section of the ESF of FIG. 20.
Figure 22:
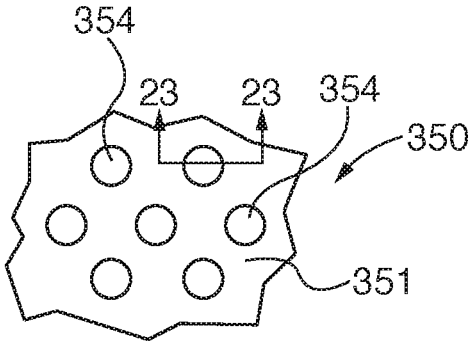
FIG. 22 is a fragmentary view of a turbine component having an exemplary embodiment of a plurality of cylindrical or post-like profile engineered surface features (ESFs) forming in combination a hexagonal planform pattern on its substrate surface that surround or circumscribes another centrally located post-like ESF.
Figure 23:
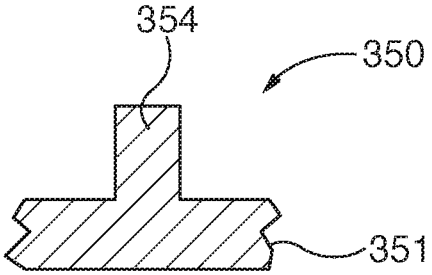
FIG. 23 is a cross section of the ESF of FIG. 22.
Figure 24:
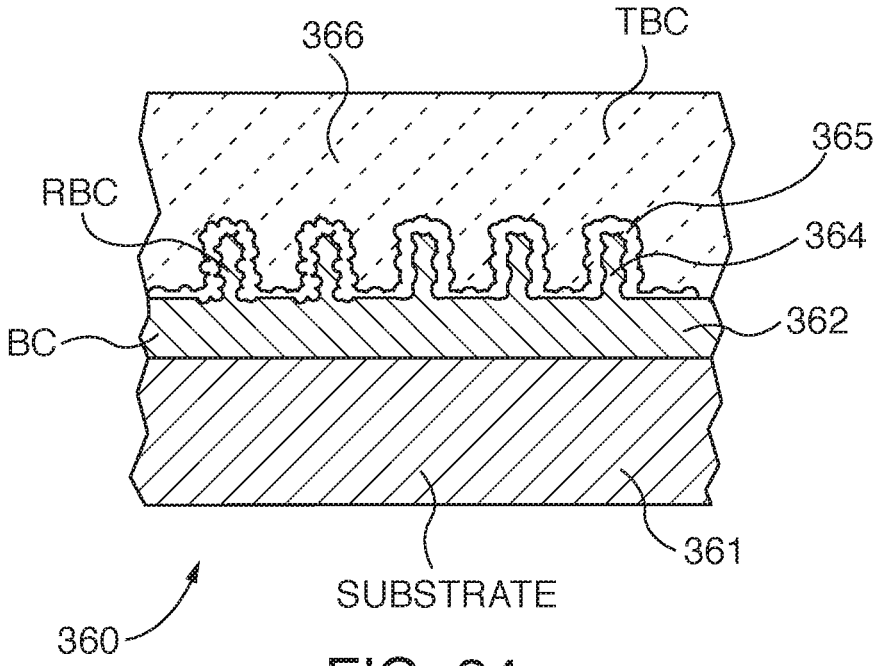
FIG. 24 is a fragmentary view of a turbine component having an exemplary embodiment of a roughened bond coat (RBC) layer applied over previously formed engineered surface features (ESFs) in a lower BC that was previously applied to the component substrate.
Figure 25:
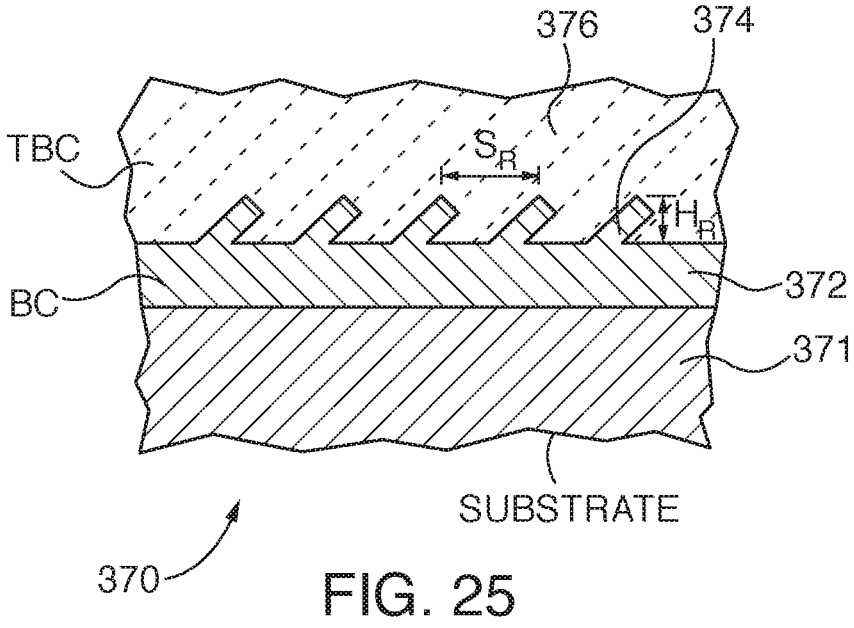
FIG. 25 is a schematic cross section of a turbine component having an exemplary embodiment of engineered surface features (ESFs) that are angled relative to the underlying substrate surface.

In exemplary embodiments the ESFs are selectively arrayed in three-dimensional planform linear or polygonal patterns. For example the ESF planform pattern of parallel vertical projections shown in FIGS. 16, 19, 23 and 24 can also be repeated orthogonally or at a skewed angle in the plane projecting in and out of the drawing figures. In FIGS. 20 and 21 the turbine component 340 has a metallic substrate 341 with ESFs 354 formed therein, comprising a hexagonal planform of dual grooves circumscribing an upper groove, which is similar to the cross sectional profile of the turbine abradable component 220 dual height ridges 228A. In FIGS. 22 and 23 the turbine component 350 has a metallic substrate 351 with ESFs 354 formed therein, comprising cylindrical pins. For visual simplicity of FIGS. 20-23, the turbine components 340 and 350 are shown without a TBC layer covering the ESFs 344 or 354. The ESFs 344 or 354 are generally repeated over at least a portion of the surface of their respective substrates. The three-dimensional planform patterns can also be varied locally to the turbine component surface topology. While the ESFs shown in FIGS. 20-23 are formed directly in their respective substrates, as previously discussed they may be formed in a bond coat that is applied over a featureless substrate.

Figure 26:
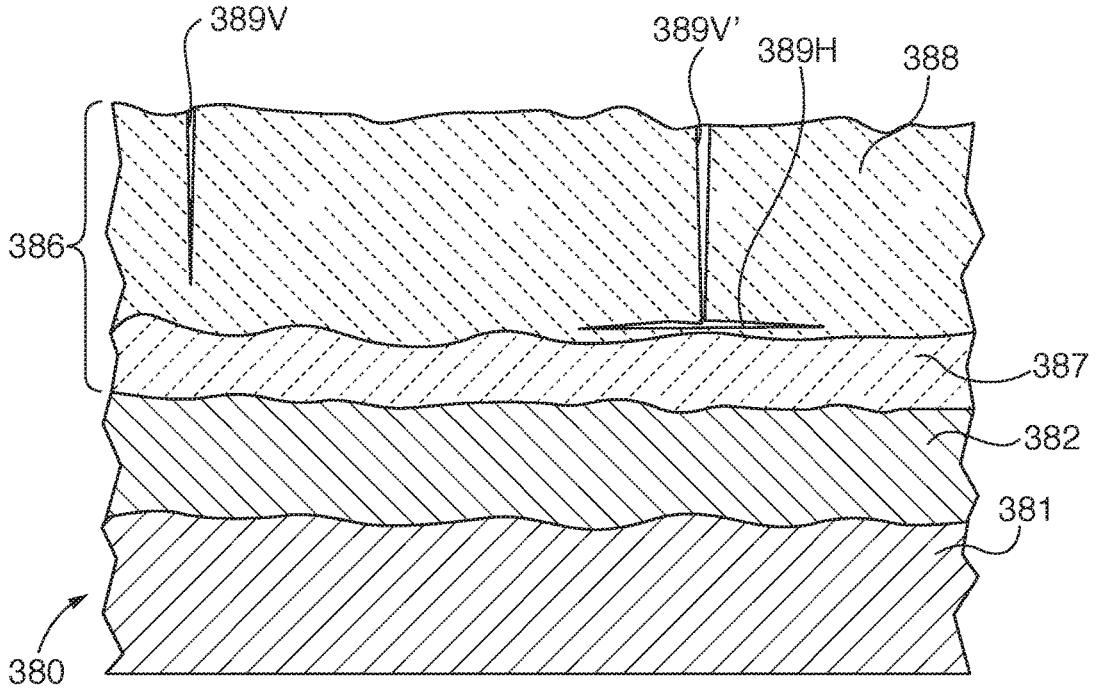
FIG. 26 PRIOR ART
FIG. 26 is a fragmentary cross section of a prior art turbine component experiencing vertical and horizontal crack formation in a bi-layer TBC, having a featureless surface bond coat (BC) applied over a similarly featureless surface substrate.

As previously mentioned, in addition to TBC layer anchoring advantages provided by the ESFs described herein, they also localize TBC layer crack propagation. In the turbine component 380 of FIG. 26, thermally and/or foreign object induced cracks 389V and 389 H have formed in an outer TBC layer 388 of bi-layer TBC 386. The inner TBC layer 387, usually having different material properties than the outer TBC layer 388, is coupled to a bond coat layer 382, with the BC layer in turn coupled to the component metallic substrate 381. The right-most vertical crack 389V' has penetrated to the interface of the outer 388 and inner 387 TBC layers and is now propagating horizontally as crack 389H. Further propagation of the crack 389H may cause delamination of the outer TBC layer 388 from the rest of the turbine component 380 and ultimately potential spallation of all outer TBC layer material located between the right- and left-most vertical cracks 389V and 389V'. Spallation ultimately reduces overall thermal insulative protection for the underlying metallic substrate 381 below the spallation zone.

Figure 27:
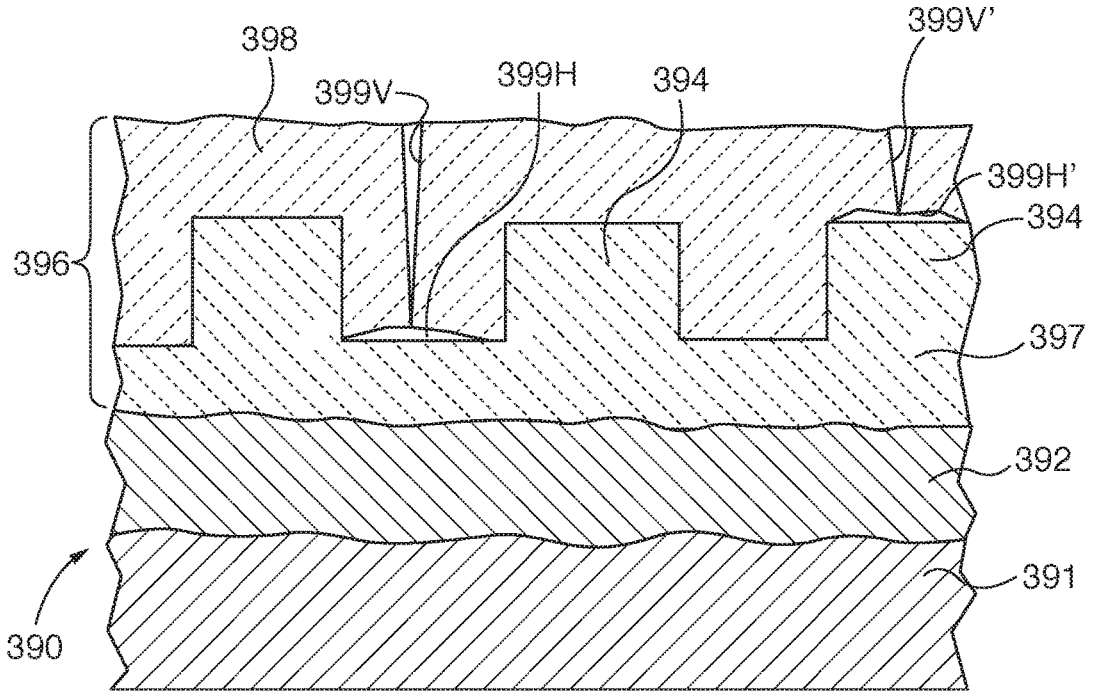
FIG. 27 is a fragmentary cross section of a turbine component having an exemplary embodiment of engineered surface features (ESFs) formed in a lower TBC layer, wherein vertical and horizontal crack propagation has been arrested and disrupted by the ESFs.

Now compare the crack propagation resistant construction of the turbine component 390 shown in FIG. 27. The metallic substrate 391 also has a BC over layer 382 to which is affixed a TBC layer 396. The TBC layer 396 further comprises a lower thermal barrier coating (LTBC) layer 397 that has ESFs 394 formed therein for interlocking with the outer thermal barrier coat (OTBC) layer 398. Thus the LTBC layer 397 with its ESFs 394 effectively functions as the anchoring layer for the OTBC layer 398. In some embodiments the LTBC layer 397 has greater strength and ductility material properties than the OTBC layer 398, while the latter has greater thermal resistivity and brittleness material properties. Vertical crack 399V has propagated through the entire thickness of the OTBC 398, but further vertical propagation has been arrested at the interface of the LTBC 397. While the vertical crack 399V has spread to form horizontal crack 399H along the OTBC/LTBC interface, the horizontal crack propagation is further arrested upon intersection with vertical walls of the ESFs 394 that flank the horizontal crack zone, so that potential delamination of the OTBC is confined to the groove width between the ESFs. Should all or part of the OTBC layer above the horizontal crack 399H spall from the remainder of the component the relatively small surface area of the now exposed LTBC will better resist thermal damage potential to the underlying turbine component substrate 391. Similarly, vertical propagation of the vertical crack 399V' is arrested upon intersection with the top ridge surface of the ESF abutting that crack. Arresting further vertical penetration of the crack 399V' reduces likelihood of OTBC spallation around the crack.

Engineered Groove Features (EGFs) Enhance TBC Crack Isolation

Some exemplary turbine component embodiments incorporate planform arrays of engineered groove features (EGFs), which are formed in the outer surface of the TBC after the TBC layer application. The EGFs groove axes are selectively oriented, at any skew angle relative to the TBC outer surface and extend into the TBC layer. Analogous to a firefighter fire line, the EGFs isolate cracks in the TBC layer, so that they do propagate across the boundary of a groove void into other portions of adjoining TBC material. Generally if a crack in the TBC ultimately results in spallation of material above the crack the EGF array surrounding the crack forms a localized boundary perimeter of the spall site, leaving TBC material outside the boundary intact. Within the spallation zone bounded by the EGFs damage will be generally limited to loss of material above the EGF groove depth. Thus in many exemplary embodiments EGF depth is limited to less than the total thickness of all TBC layers, so that a volume and depth of intact TBC material remains to provide thermal protection for the local underlying component metallic substrate. In some embodiments the EGF arrays are combined with ESF arrays to provide additional TBC integrity than either might provide alone.

Figure 28:
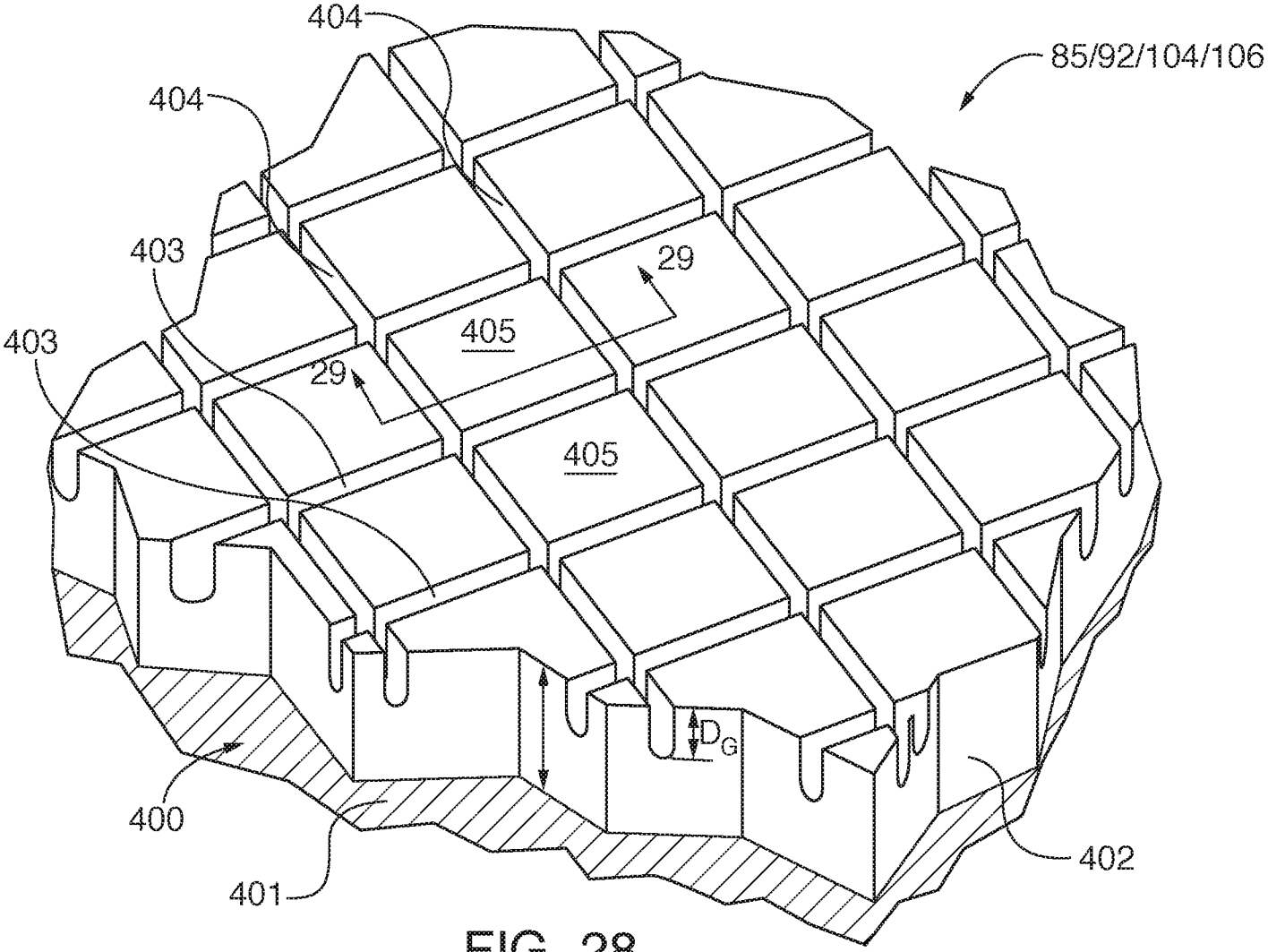
FIG. 28 is a fragmentary perspective view of a turbine component having an exemplary embodiment of engineered groove features (EGFs) formed in the thermal barrier coat (TBC) outer surface.
Figure 29:
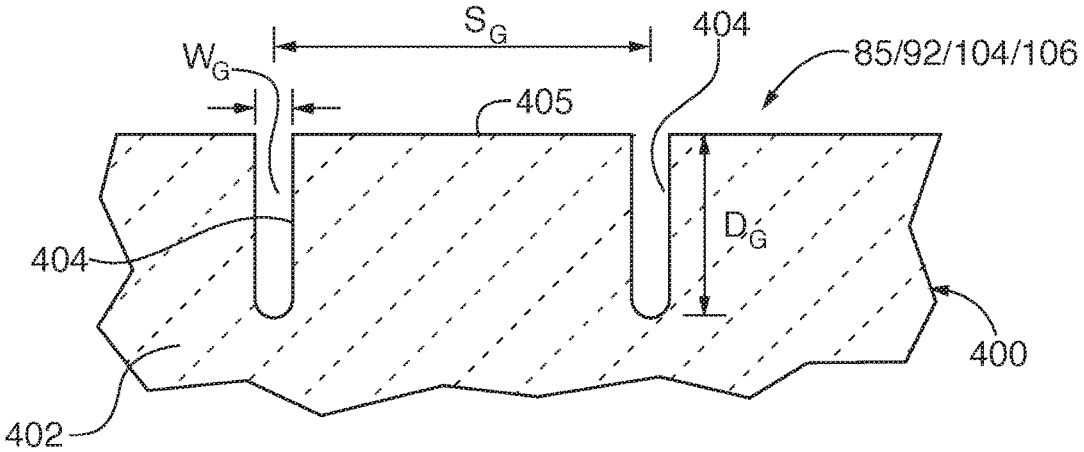
FIG. 29 is a schematic cross sectional view of the turbine component of FIG. 28 having engineered groove features (EGFs) formed in the thermal barrier coat (TBC)

FIGS. 28 and 29 show a turbine component 400 having an underlying metallic substrate 401 onto which is affixed a TBC substrate 402 with an exemplary three-dimensional planform array of orthogonally intersecting engineered groove features EGFs 403, 404 that were formed after TBC layer application. The grooves 403 and 404 are constructed with one or more groove depths $D_G$, groove widths $W_G$, groove spacing $S_G$ and/or polygonal planform array pattern. Pluralities of any of different groove depth, spacing, width and polygonal planform pattern can be varied locally about the turbine component surface. For example, three-dimensional planform polygonal patterns can be repeated across all or portions of the component surface and groove depths may be varied across the surface. While the TBC layer 402 is shown as directly coupled to the substrate 401 intermediate anchoring layer constructions previously described can be substituted in other exemplary embodiments, including one or more of bond coat or lower thermal barrier coat layers.

Figure 30:
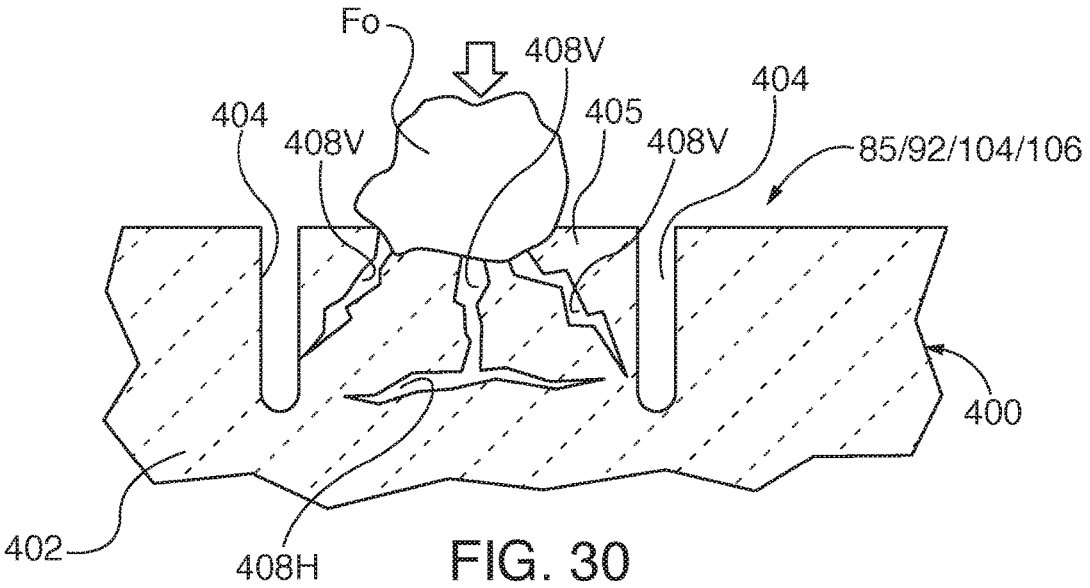
FIG. 30 is a schematic cross sectional view of the turbine component of FIG. 29 after impact by a foreign object, causing foreign object damage (FOD) in the TBC, where crack propagation has been arrested along intersections with the EGFs.
Figure 31:
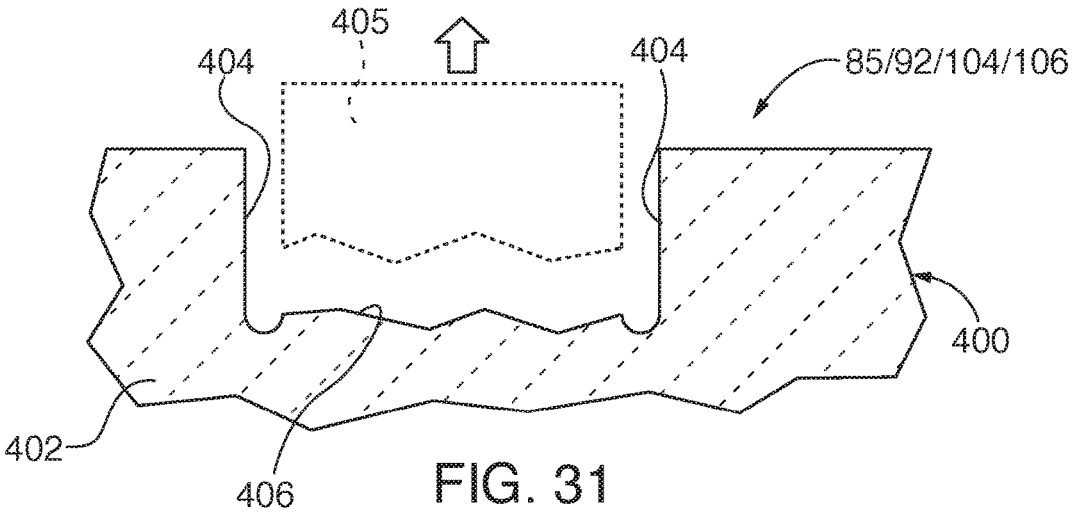
FIG. 31 is a schematic cross sectional view of the turbine component of FIG. 29 after spallation of an portion of the TBC above the cracks, leaving an intact layer of the TBC below the cracks for continuing thermal insulation of the underlying turbine component substrate.

Exemplary engineered groove feature crack isolation capabilities are shown in FIGS. 30 and 31, wherein a turbine component, such as a combustion section transition 85, a turbine blade 92 or a turbine vane 104/106 sustains foreign object FO impact damage, resulting in vertical and horizontal cracks 408H and 408V within its TBC 402 outer surface 405. The EGFs 404 flanking the impact damage stop further crack propagation across the groove void, sparing TBC material outside the groove boundaries from further cascading crack propagation. Should the TBC material in the impact zone spall from the TBC outer surface 405, remaining intact and undamaged "pot hole" TBC layer 402 material bounded by the cracks and the cratered floor 406 protects the underlying metallic substrate 401 from further damage.

Figure 32:
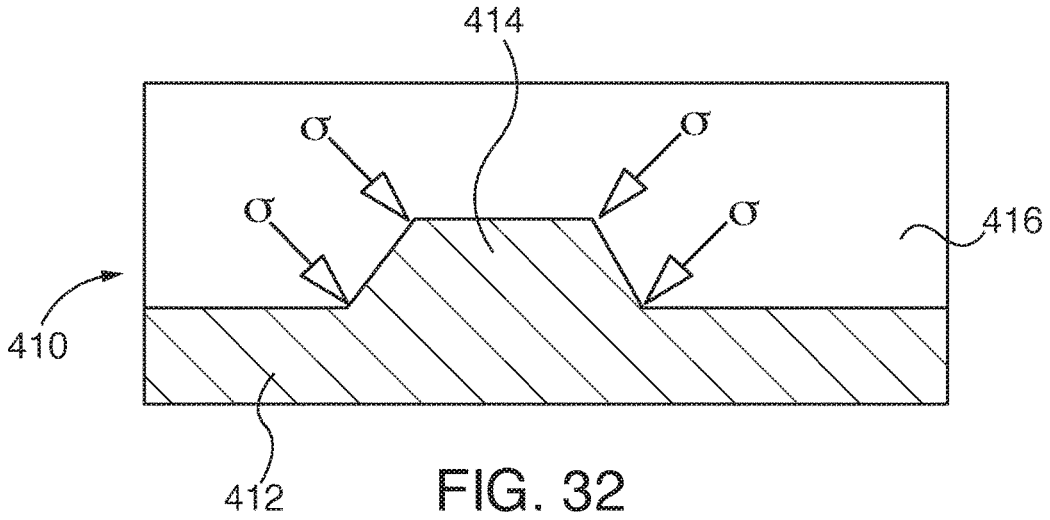
FIG. 32 is a schematic cross sectional view of a turbine component having an exemplary embodiment of a trapezoidal cross section engineered surface feature (ESF) that is anchoring the thermal barrier coat (TBC), with the arrows pointing to stress concentration zones within the TBC.
Figure 33:
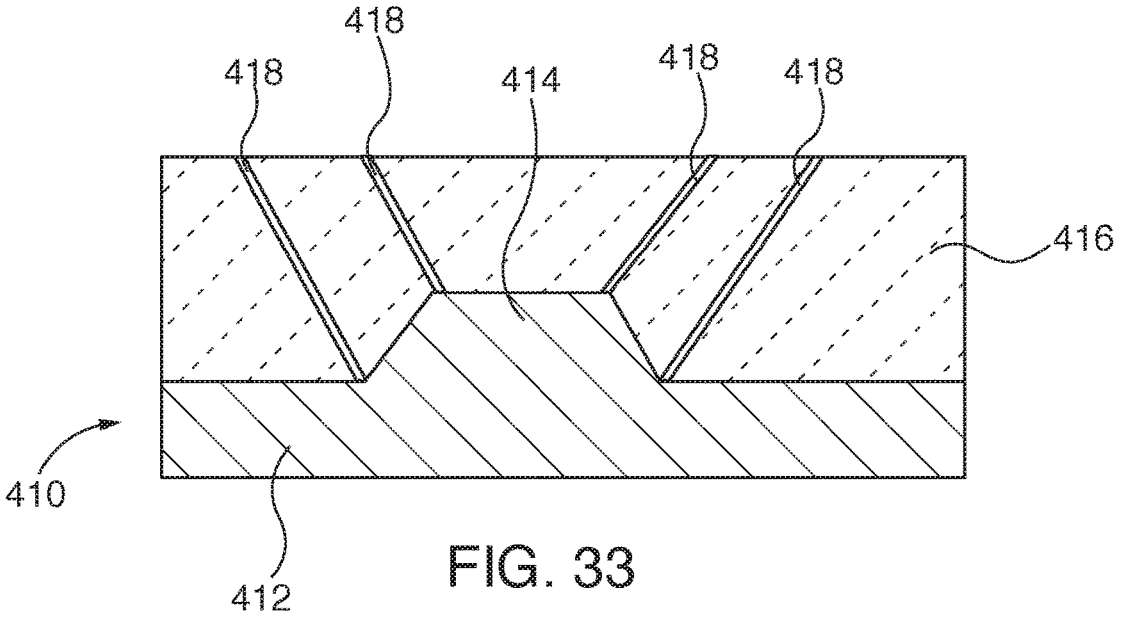
FIG. 33 is a schematic cross sectional view of the turbine component of FIG. 32, in which exemplary embodiments of angled engineered groove features (EGFs) have been cut into the TBC in alignment with the stress concentration zones in order to mitigate potential stress concentration.

Unlike prior known TBC stress crack relief mechanisms that create voids or discontinuities within the applied thermally sprayed or vapor deposited TBC layer, such as by altering layer application orientation or material porosity, the engineered groove feature (EGF) embodiments herein form cut or ablated grooves or other voids through the previously formed TBC layer outer surface to a desired depth. As shown in FIGS. 32 and 33, the turbine component 410 has an anchoring layer 412 that includes trapezoidal cross sectional profile engineered surface features 414. The arrows in FIG. 32 identify likely sites in the TBC layer 416 for actual or potential thermal or mechanical stress concentration zones σ at the intersecting edges or vertices of the ESF 414 during turbine engine operation. Accordingly EGFs 418 are cut at an angle along the stress line σ at a skewed groove axis angle into the TBC outer surface at sufficient depth to intersect the ESF 414 vertices. Stresses induced in the TBC layer on either side of the EGFs 414 do not propagate from one side to the other. The TBC layer 416 on either side of an EGF 418 is free to expand or contract along the groove void, further reducing likelihood of crack generation parallel to the groove.

Figure 34:
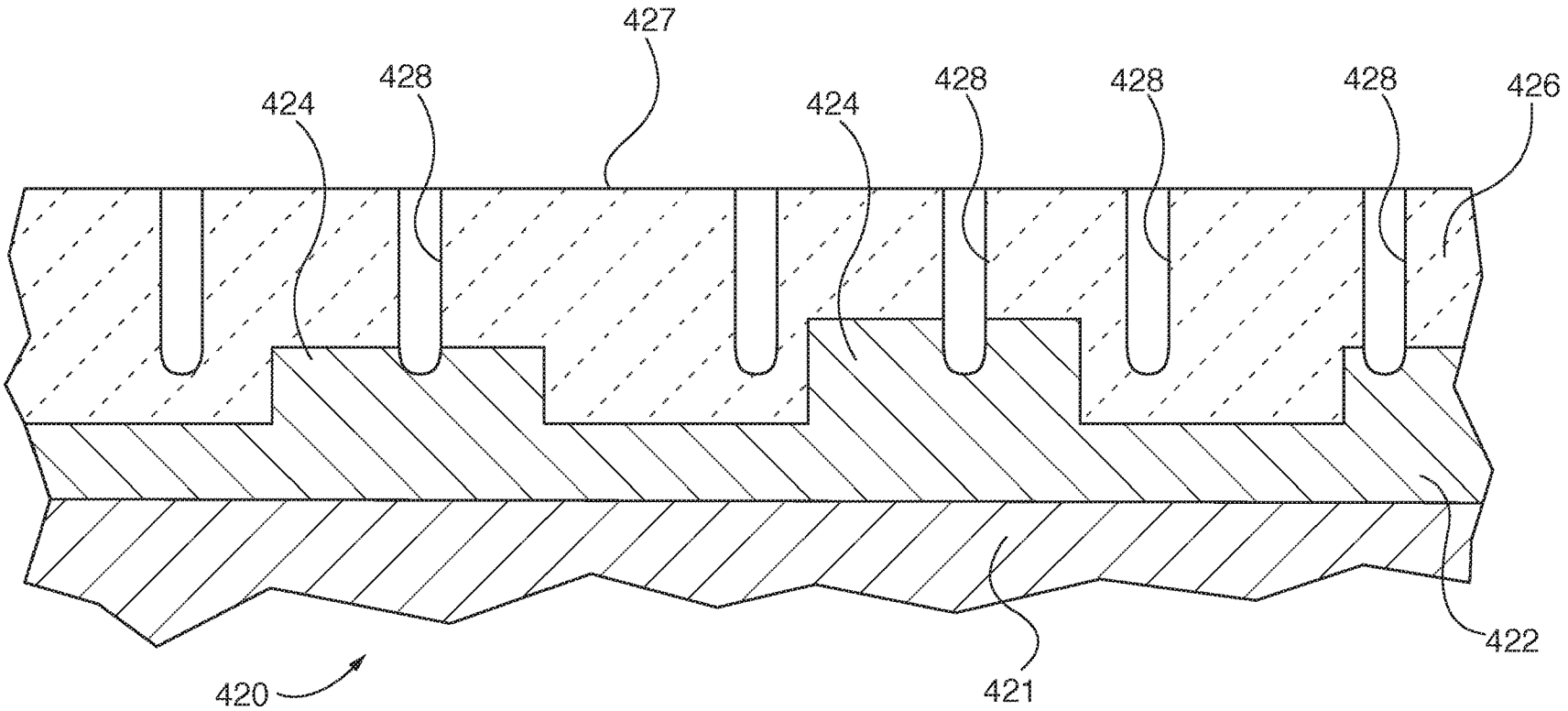
FIG. 34 is a schematic cross sectional view of an exemplary embodiment of a turbine component having both engineered surface features (ESFs) and engineered groove features (EGFs)
Figure 35:
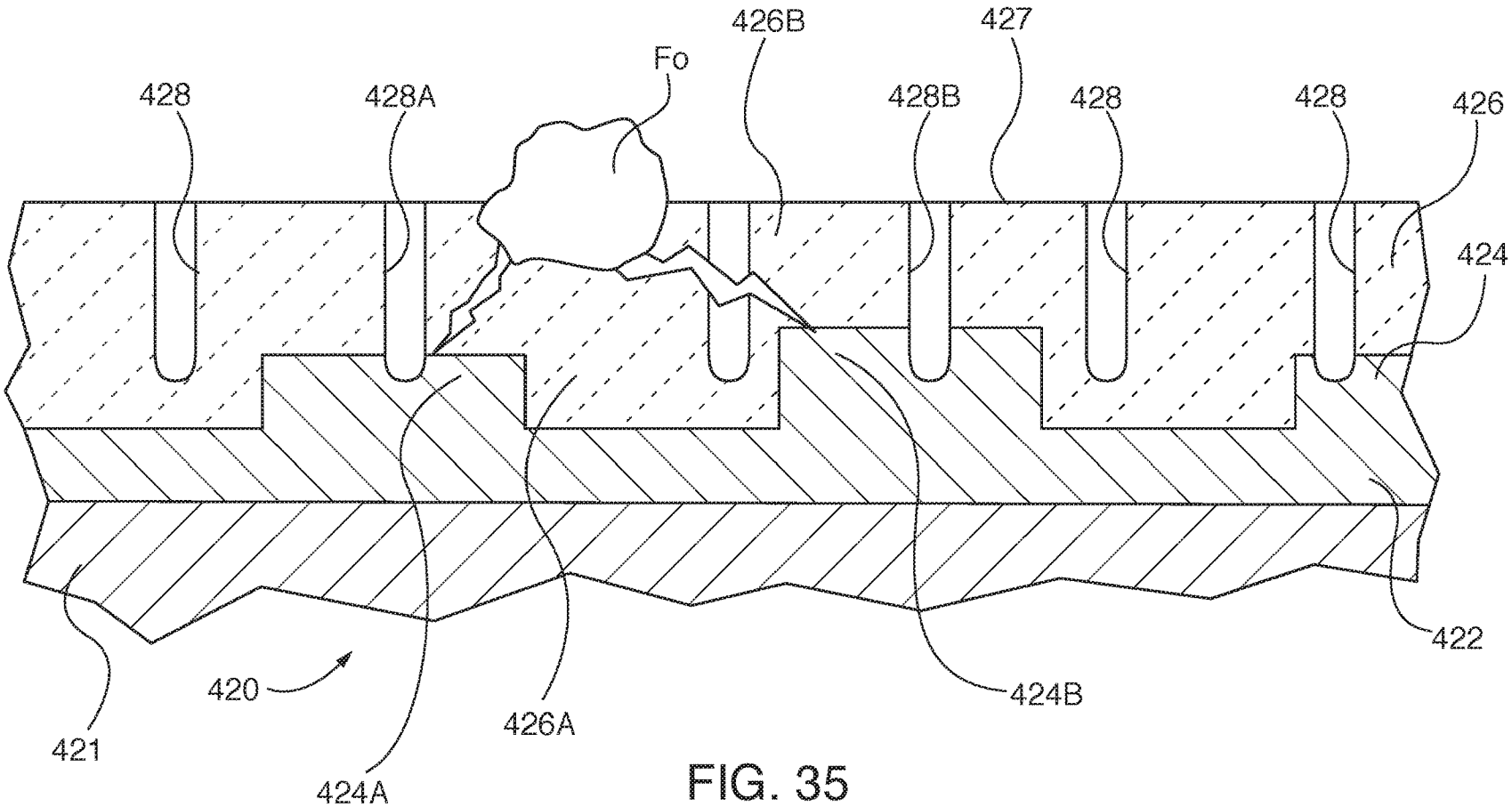
FIG. 35 is a schematic cross sectional view of the turbine component of FIG. 34, in which foreign object damage (FOD) crack propagation has been constrained by the engineered surface features (ESFs) and engineered groove features (EGFs)

The turbine component embodiments of FIGS. 33-35 show additional TBC crack inhibition and isolation advantages afforded by combination of engineered groove features (EGFs) and engineered surface features (ESFs). In FIG. 33 the advantages of relieving actual or potential stress lines σ were achieved by forming the EGF 418 all the way through the TBC 418 depth until it intersected the anchoring layer's ESF 414. In the embodiment of FIGS. 34 and 35 the turbine component 420 (e.g., turbine blade or vane or transition) metallic substrate 421 has a bond coat (BC) 422 anchoring layer, which defines engineered surface features (ESFs) 424 that are oriented in a three-dimensional planform pattern. The TBC layer 426 is applied over the anchoring layer and after which another planform three-dimensional pattern of EGFs 428 are cut through the TBC layer outer surface 427 that is exposed to combustion gasses. The EGF 428 planform patterns may differ from the ESF 424 planform patterns. If the same planform pattern is used for both the ESFs and the EGFs their respective patterns do not necessarily have to be vertically aligned within the TBC layer(s). In other words, the EGFs and ESFs may define separate three-dimensional, independently aligned planform patterns across the component. In some embodiments the ESFs and EGFs respectively have repeating three-dimensional planform patterns. Patterns may vary locally about the component surface.

In FIG. 34 the EGF 428 planform pattern does not have any specific alignment that repetitively corresponds to the ESF 424 pattern. Some of the EGFs 428 is cut into the ESF 424 ridge plateaus and others only cut into the TBC 426 layer. In FIG. 35 a foreign object FO has impacted the TBC upper surface 427, creating cracks that are arrested by the ESFs 424A, 424B and the EGFs 428A and 428B that bound or otherwise circumscribe the FO impact zone. Should The TBC material 426B that is above the cracks separate from the remainder of the turbine component 420 TBC layer, the remaining, non-damaged TBC material 426A that remains affixed to the BC anchoring layer 422 at the base of the "pot hole" provides thermal protection to its underlying metallic substrate 421.

Engineered Groove Features (EGFs)

Inhibit TBC Delamination Around Cooling Holes

Advantageously, engineered groove features can be formed in the TBC layer around part of or the entire periphery of turbine component cooling holes or other surface discontinuities, in order to limit delamination of the TBC over layer along the cooling hole or other discontinuity margins in the component substrate. The TBC layer at the extreme margin of the cooling hole can initiate separation from the metallic substrate that can spread laterally/horizontally within the TBC layer away from the hole. Creation of an EGF at a laterally spaced distance from the cooling hole margin—such as at a depth that contacts the anchoring layer or the metallic substrate—limits further delamination beyond the groove.

Figure 36:
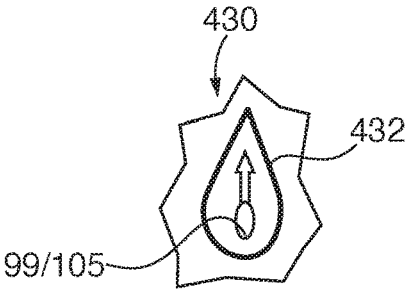
FIGS. 36-43 show exemplary embodiments of engineered groove feature (EGFs) formed in a turbine component thermal barrier coating (TBC) outer surface near component cooling holes, in order to arrest propagation of cracks or delamination of the TBC layer in zones surrounding the cooling holes to the surface area on the opposite sides of the grooves.
Figure 37:
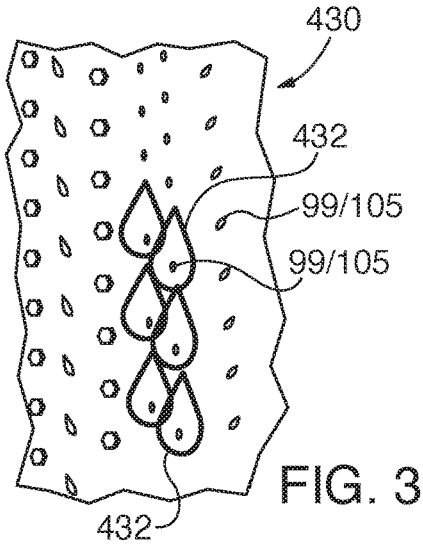

Various cooling hole periphery EGF embodiments are shown in FIGS. 36-43. In FIGS. 36-37 the turbine component 430, for example a turbine blade or a turbine vane, has a plurality of respective cooling holes 99/105 that are fully circumscribed by a teardrop planform EGFs 432. TBC delamination along one or more of the cooling hole peripheral margins is arrested at the intersection of the circumscribing EGF 432. For brevity, further description of hole periphery EGFs is limited to the groove shape and orientation. Underlying substrate, anchoring layer, ESF and any other EGFs are constructed in accordance with prior descriptions previously as described.

Figure 38:
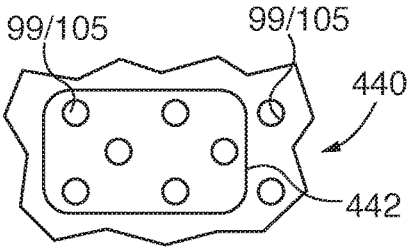
Figure 39:
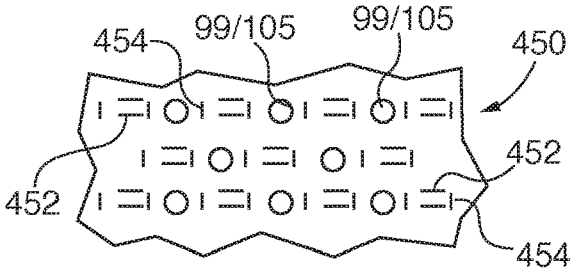
Figure 40:
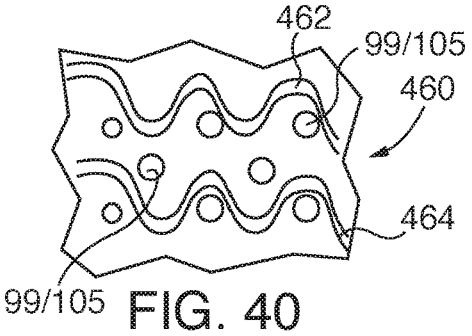
Figure 41:
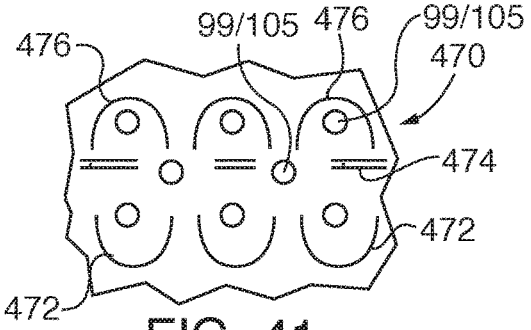
Figure 42:
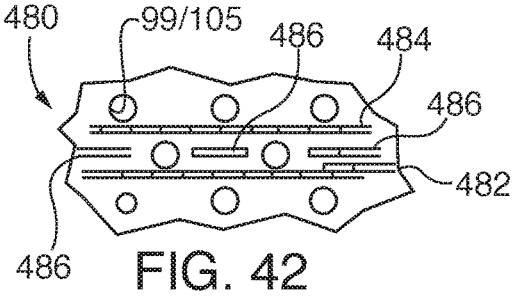
Figure 43:
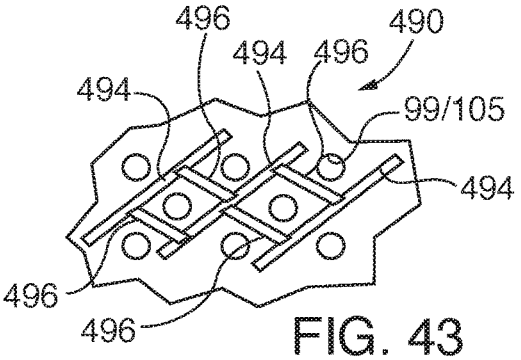

In FIG. 38 the turbine component 440 has an EGF 442 that circumscribes a plurality of cooling holes 99/105, which is analogous to a ditch or moat surrounding the hole cluster. Propagation of any surface delamination within the cluster of cooling holes 99/105 surrounded by the EGF 442 is confined within the EGF 442. In the embodiments of FIGS. 39-41 the EGFs do not fully surround any one cooling hole, but delamination spread is likely to be arrested by one or more partially circumscribing EGSs near one or more of the holes. In FIG. 39 one or more of horizontally oriented EGFs 452 or vertically oriented EGFs 454 in the turbine component 450 TBC outer layer surface partially or fully surrounds each of the cooling holes 99/105. In FIG. 40 the cooling holes 99/105 of the turbine component 460 are fully or partially circumscribed by the undulating ribbon-like EGFs 462 or 464. In the turbine component embodiment 470 of FIG. 41 a combination of linear EGFs 474 and semi-circular or arcuate EGFs 476 at least partially circumscribe the cooling holes 99/105. The turbine component 480 of FIG. 42 has overlapping linear EGFs 482 and 484 along with segmented linear EGFs 486 that isolate rows of cooling holes 99/105 from each other. In FIG. 42 the linear EGF segments 494 and 496 of turbine component 490 fully or partially circumscribe cooling holes 99/105 from each other.

Material Varying Multi-Layer and Graded TBC Construction

Figure 44:
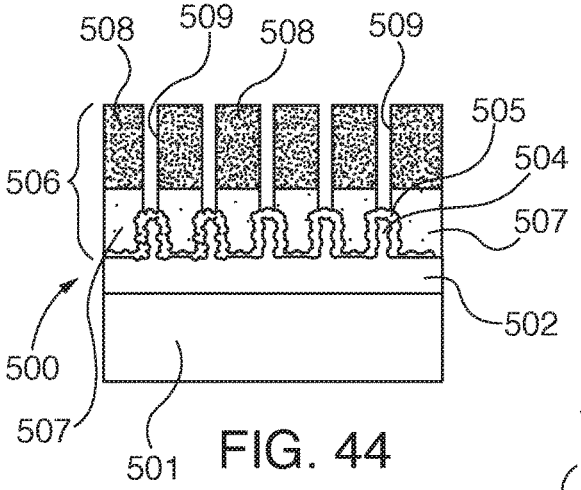
FIG. 44 is a schematic cross sectional view of an exemplary embodiment of a turbine component with engineered surface features (ESFs), engineered groove features (EGFs) and a thermally sprayed or vapor deposition-formed multi-layer thermal barrier coat (TBC) whose material physical ductility, strength and thermal resistivity properties vary from the TBC layer inner surface to the TBC layer outer surface.
Figure 45:
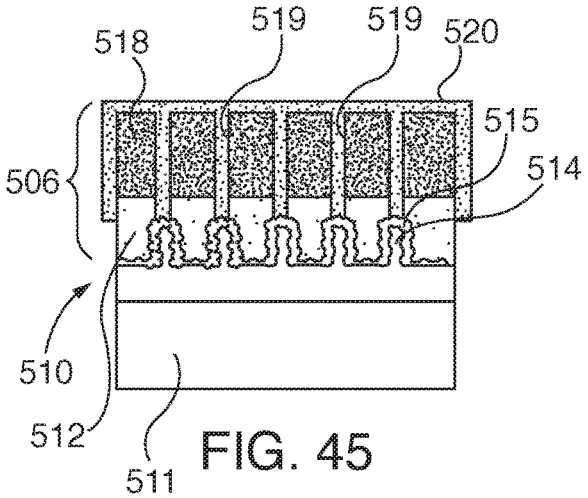
FIG. 45 is a schematic cross sectional view of an alternative embodiment of the turbine component of FIG. 44, further comprising a thermally sprayed calcium-magnesium-aluminum-silicon (CMAS)-retardant layer applied over the TBC outer surface and into the EGFs.
Figure 46:
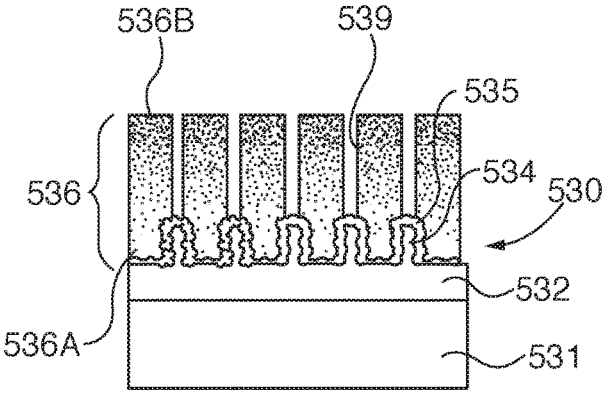
FIG. 46 is a schematic cross sectional view of an alternative embodiment of the turbine component of FIG. 44, with the thermal barrier coat (TBC) formed by the process of varying composition of the TBC layer progressively as the TBC layer is being applied over the ESFs.
Figure 47:
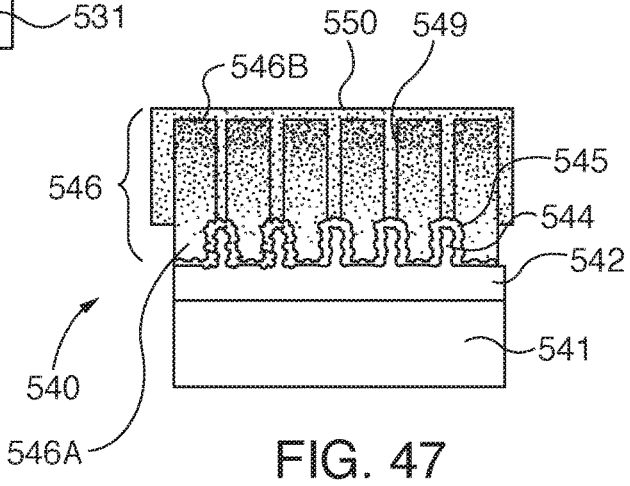
FIG. 47 is a schematic cross sectional view of an alternative embodiment of the turbine component of FIG. 46, further comprising a thermally sprayed calcium-magnesium-aluminum-silicon (CMAS)-retardant layer applied over the TBC outer surface and into the EGFs.

As was previously discussed, the aggregate thermally sprayed TBC layer of any turbine component embodiment described herein may have different local material properties laterally across the component surface or within the TBC layer thickness dimension. As one example, one or more separately applied TBC layers closest to the anchoring layer may have greater strength, ductility, toughness and elastic modulus material properties than layers closer to the component outer surface but the higher level layers may have greater thermal resistivity and brittleness material properties. Multi-layer TBC embodiments are shown in FIGS. 44 and 45. Alternatively a graded TBC layer construction can be formed by selectively varying constituent materials used to form the TBC layer during a continuous thermal spraying process, as is shown in FIGS. 46 and 47. In some embodiments a calcium-magnesium-aluminum-silicon (CMAS)-resistant layer is applied over TBC outer surface, for inhibiting adhesion of contaminant deposits to the TBC outer surface. Undesirable contaminant deposits can alter material properties of the TBC layer and decrease aerodynamic boundary conditions along the component surface. In embodiments where a CMAS-resistant layer is applied over and infiltrates EGF grooves that are formed in the TBC outer surface layer it enhances aerodynamic boundary conditions by forming a relatively smoother TBC outer surface and also inhibits debris accumulation within the grooves.

Exemplary material compositions for thermal barrier coat (TBC) layers include yttria stabilized zirconia, rare-earth stabilized zirconia with a pyrochlore structure, rare-earth stabilized fully stabilized cubic structure, or complex oxide crystal structures such as magnetoplumbite or perovskite or defective crystal structures. Other exemplary TBC material compositions include multi-element doped oxides with high defect concentrations. Examples of CMAS retardant compositions include alumina, yttrium aluminum oxide garnet, slurry deposited/infiltrated highly porous TBC materials (the same materials that are utilized for OTBC or LTBC compositions) and porous aluminum oxidized to form porous alumina.

In FIG. 44 the turbine component 500 has a metallic substrate 501, which is covered by a bond coat (BC) layer 502 that includes engineered surface features (ESFs) 504. The BC layer in turn covered with a rough bond coat (RBC) layer 505. A multi-layer TBC layer 506, comprising a lower thermal barrier coat (LTBC) 507 and a subsequently applied outer thermal barrier coat (OTBC) 508, is applied over the RBC layer 505. While two layers are shown in this embodiment additional layers may be applied between the LTBC 507 and the OTBC 508 layers. Engineered groove features (EGFs) 519 are subsequently cut into the TBC layer's outer surface: in this embodiment sufficiently deep to contact the RBC layer 505.

In the embodiment of FIG. 45, the turbine component 510 has a substantially similar overall construction to the embodiment of FIG. 44, with an additional calcium-magnesium-aluminum-silicon (CMAS)-resistant layer 520 applied over the TBC outer surface. The component 510 includes a metallic substrate 511, a bond coat (BC) layer 512, which includes engineered surface features (ESFs) 514 and a rough bond coat (RBC) layer 515. A multi-layer TBC layer 516, comprising a lower thermal barrier coat (LTBC) 517 and a subsequently applied outer thermal barrier coat (OTBC) 518 is applied over the RBC layer 515. Engineered groove features (EGFs) 519 are subsequently cut into the TBC layer's outer surface 518, for stress relief and potential crack isolation in the TBC. The CMAS-resistant layer 520 is applied over the TBC layer's outer surface, where it infiltrates and anchors within the EGFs 519. The CMAS-resistant layer inhibits accumulation of debris within the EGFs 519 and its relatively smooth surface enhances boundary layer aerodynamics along the combustion gas contact surface. Exemplary CMAS retardant layer thickness range is between 20-200 microns.

The continuously-applied, thermally sprayed and graded TBC layer construction turbine component 530 of FIG. 46 has a general construction similar to that of FIG. 44. The FIG. 46 embodiment substitutes a graded TBC layer 536 for the former's layered TBC 506. The turbine component 530 includes metallic substrate 531 that is covered by a bond coat (BC) layer 532, which includes engineered surface features (ESFs) 534 and is in turn covered with a rough bond coat (RBC) layer 535. A graded TBC layer 536 is applied over the RBC layer 535, with the lower portion 536A of the layer having different material properties than the upper portion 536B of the layer. Engineered groove features (EGFs) are subsequently cut into the TBC outer surface for stress relief and potential crack isolation in the TBC.

In the embodiment of FIG. 47, the turbine component 540 has a substantially similar overall construction to the embodiment of FIG. 46, with an additional CMAS-resistant layer 550 applied over the TBC outer surface. The component 540 includes a metallic substrate 541, a bond coat (BC) layer 542, which includes engineered surface features (ESFs) 544 and a rough bond coat (RBC) layer 545. A graded TBC layer 546 is applied over the RBC layer 535, with the lower portion 546A of the layer having different material properties than the upper portion 546B of the layer. Engineered groove features (EGFs) 549 are subsequently cut into the TBC layer's outer surface, for stress relief and potential crack isolation in the TBC. The CMAS-resistant layer 550 is applied over the TBC layer's outer surface, where it infiltrates and anchors within the EGFs 549. Advantages of the CMAS-resistant layer were previously described in reference to the embodiment of FIG. 45.

Segmented TBC Construction

Figure 48:
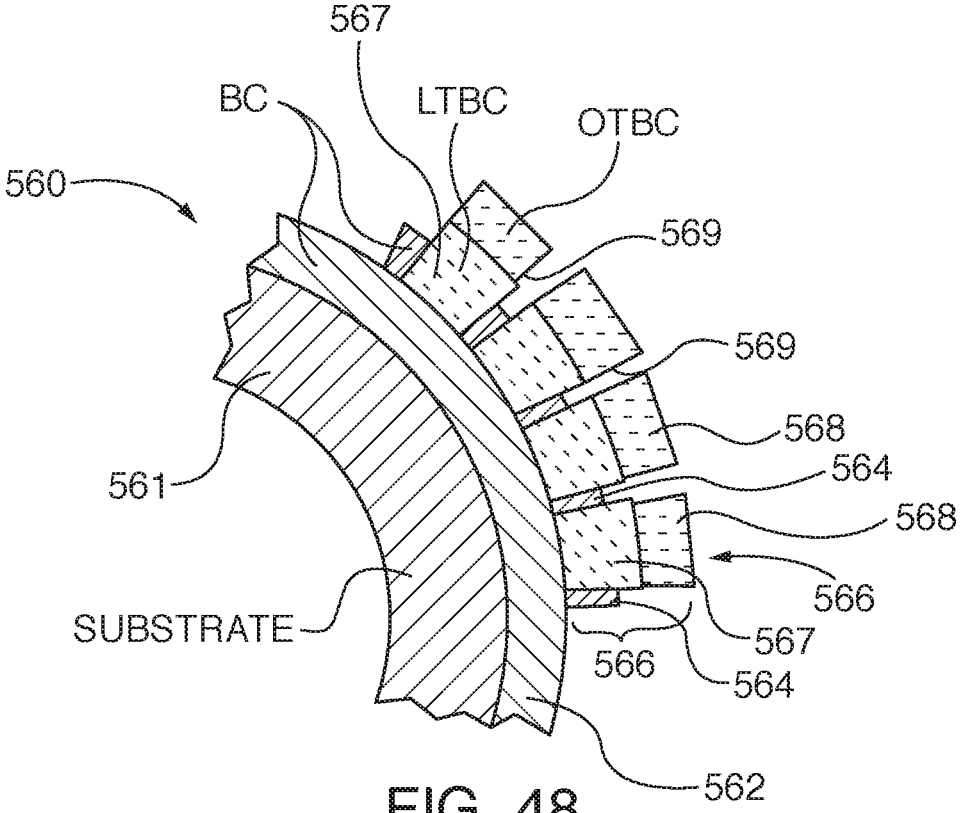
FIG. 48 is a schematic cross sectional view of an exemplary embodiment of a curved surface turbine component with engineered surface features (ESFs), engineered groove features (EGFs) and a thermally sprayed or vapor deposited multi-layer thermal barrier coat (TBC)
Figure 49:
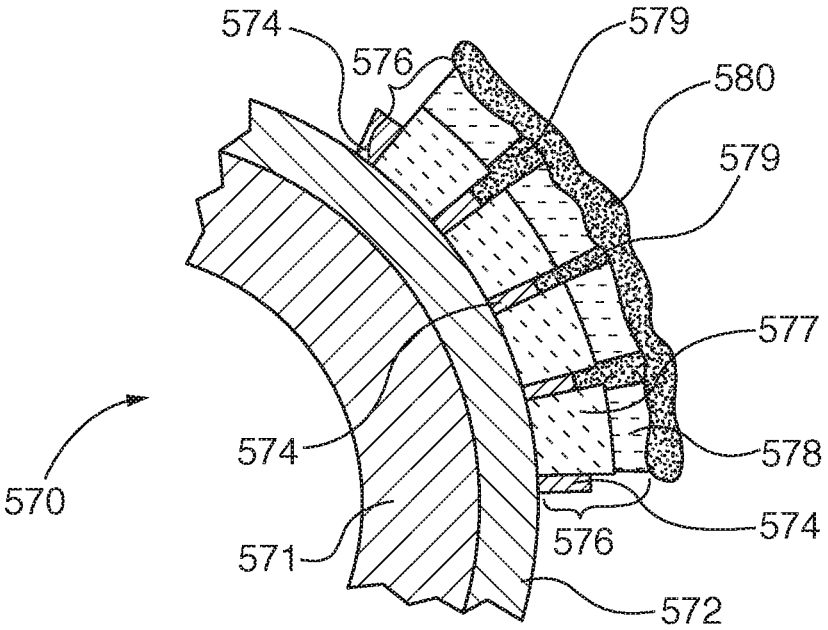
FIG. 49 is an alternative embodiment of the curved turbine component of FIG. 48, further comprising a thermally sprayed calcium-magnesium-aluminum-silicon (CMAS)-retardant layer applied over the TBC outer surface and into the EGFs.

Segmented TBC construction embodiments, which are conceptually analogous to an ear of corn or maize, combine engineered surface features (ESFs) and engineered groove features (EGFs) embodiments along with optional combinations of multi-layer or graded material-varying thermal barrier coat and CMAS-resistant surface coatings. The segmented TBC construction is suitable for curved as well as flat surfaces of turbine engine components, such as combustion section transitions, blades and vanes. Exemplary segmented TBC protected, curved surface turbine components are shown in FIGS. 48 and 49. Both of these exemplary embodiments feature similar construction EGFs and ESFs, along with bi-layer TBC layers, but differ by whether there is application of a CMAS-resistant outer layer that is exposed to combustion gasses. The CMAS retardant layer thickness is generally within the range of between 20-200 microns.

In FIG. 48 the turbine component embodiment 560 has a curved surface substrate 561, such as on the leading edge of a turbine blade or vane. A bond coat BC 562 is applied to the substrate and includes a three-dimensional planform array of waffle pattern-like ESFs 564 that define wells or holes for anchoring of a bi-layer thermal barrier coat 566. The TBC 566 includes a lower thermal barrier coat (LTBC) 567 and an outer thermal barrier coat (OTBC) 568. EGFs 569 are cut into the outer surface of the OTBC 568 in a waffle-like three-dimensional planform array that does not necessarily have to be aligned concentrically with the ESF 564 array pattern within the TBC layer 566. If so aligned, each bi-layer three-dimensional segment that is captured in the similar groove formed within the ESFs 564 is analogous to a kernel or corn or maize that is embedded within its cob.

The turbine component embodiment 570 of FIG. 49 adds a CMAS-resistant layer 580 to the surface of the OTBC layer 578 that penetrates the EGFs 579. Otherwise construction of the Substrate 571, BC 572 along with ESFs 574, TBC layer 576, LTBC layer 577 and the OTBC layer 578 are substantially similar to the embodiment 560 of FIG. 48. Advantages of an additional CMAS-resistant layer were discussed in reference to the embodiment of FIG. 45.

Although various embodiments that incorporate the teachings of the invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. For example, various ridge and groove profiles may be incorporated in different planform arrays that also may be locally varied about a circumference of a particular engine application. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted", "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A combustion turbine component having a heat insulating outer surface for exposure to combustion gas, comprising:

a metallic substrate having a substrate surface;

an anchoring layer built upon the substrate surface;

a thermal barrier coat (TBC) layer having a TBC total thickness, a TBC inner surface coupled to the anchoring layer and a TBC outer surface for exposure to combustion gas, the TBC layer comprising a progressively decreasing fracture toughness, elastic modulus, and thermal conductivity properties from the TBC inner surface to the TBC outer surface and an increasing porosity from the TBC inner surface to the TBC outer surface;

a planform pattern of engineered surface features (ESFs) projecting from the anchoring layer having projection height between approximately 2-75 percent of the TBC layer total thickness; and a planform pattern of engineered groove features (EGFs) formed into and penetrating the previously applied TBC layer through the TBC outer surface, having a groove depth.

2. The component of claim 1, the anchoring layer further comprising a lower thermal barrier coat (LTBC) layer portion defining the planform pattern of ESFs and the thermal barrier coat (TBC) layer further comprising an outer thermal barrier coat (OTBC) layer portion separately applied over the LTBC, having an OTBC inner surface coupled to the LTBC and an OTBC outer surface for exposure to combustion gas;

the LTBC layer portion having greater fracture toughness and elastic modulus than the OTBC layer portion; and the OTBC layer portion having greater porosity and lower thermal conductivity than the LTBC layer portion.

3. The component of claim 2, further comprising a calcium magnesium-aluminum-silicon (CMAS)-retardant layer applied over the OTBC outer surface and into the EGFs.

4. The component of claim 1, the anchoring layer further comprising a bond coat layer coupled to the substrate and the ESFs formed in the bond coat layer.

5. The component of claim 1, the anchoring layer further comprising a bond coat (BC) layer coupled to a featureless substrate and the ESFs formed in the BC layer.

6. The component of claim 5, the anchoring layer further comprising a rough bond coat layer applied over the BC layer.

7. A combustion turbine engine comprising the component of claim 1, the component TBC outer surface in communication with a combustion path of the engine for exposure to combustion gas.

8. The combustion turbine engine of claim 7, the component ESFs defining an aggregate surface area at least 20 percent greater than an equivalent flat surface.

9. A method for making a combustion turbine component having a heat insulating outer surface for exposure to combustion gas, comprising:

providing a metallic substrate having a substrate surface;

building an anchoring layer upon the substrate surface;

forming a thermal barrier coat (TBC) having a TBC layer thickness, an inner surface coupled to the anchoring layer and a TBC outer surface for exposure to combustion gas; and varying composition of the TBC layer material progressively as the TBC layer is being continuously applied over the anchoring layer by progressively decreasing fracture toughness, elastic modulus and thermal conductivity and progressively increasing porosity as the TBC layer is being applied over the anchoring layer.

10. The method of claim 9, further comprising forming a planform pattern of engineered groove features (EGFs) penetrating the previously applied TBC layer through the TBC outer surface, having a groove depth.

11. The method of claim 10, further comprising thermally spraying a calcium magnesium-aluminum-silicon (CMAS)-retardant layer over the TBC outer surface and into the EGFs.

12. The method of claim 9, further comprising forming a planform pattern of engineered groove features (EGFs) penetrating the previously applied TBC layer through the TBC outer surface, having a groove depth.

13. The method of claim 12, further comprising thermally spraying a calcium magnesium-aluminum-silicon (CMAS)-retardant layer over the TBC outer surface and into the EGFs.

14. A method for making a combustion turbine component having a heat insulating outer surface for exposure to combustion gas, comprising:

providing a metallic substrate having a substrate surface;

building an anchoring layer upon a substrate surface of a metallic substrate, the substrate surface including a planform pattern of engineered surface features (ESFs) projecting from the anchoring layer;

forming a thermal barrier coat (TBC) having a TBC layer thickness, an inner surface coupled to the anchoring layer and a TBC outer surface for exposure to combustion gas, by progressively decreasing fracture toughness, elastic modulus and thermal conductivity and progressively increasing porosity as the TBC layer is being applied over the anchoring layer; and forming a planform pattern of engineered groove features (EGFs) penetrating the previously applied TBC layer through the TBC outer surface, having a groove depth.

15. The method of claim 14, the anchoring layer forming further comprising:

applying a lower thermal barrier coat (LTBC) layer portion defining the planform pattern of ESFs; and the thermal barrier coat (TBC) layer further comprising an outer thermal barrier coat (OTBC) layer portion separately applied over the LTBC, having an OTBC inner surface coupled to the LTBC and an OTBC outer surface for exposure to combustion gas;

the LTBC layer portion having greater fracture toughness and elastic modulus than the OTBC layer portion; and the OTBC layer portion having greater porosity and lower thermal conductivity than the LTBC layer portion.

* * * * *